US012396519B1

(12) United States Patent
Xiang

(10) Patent No.: US 12,396,519 B1
(45) Date of Patent: Aug. 26, 2025

(54) PAWL DISC, LACE TIGHTENING AND LOOSENING DEVICE, WEARABLE CLOTHING, AND STORAGE DEVICE

(71) Applicant: SHENZHEN ETIE TECHNOLOGY LTD., Guangdong (CN)

(72) Inventor: Feng Xiang, Guangdong (CN)

(73) Assignee: SHENZHEN ETIE TECHNOLOGY LTD., Shenzhen (CN)

( * ) Notice: Subject to any disclaimer, the term of this patent is extended or adjusted under 35 U.S.C. 154(b) by 0 days.

(21) Appl. No.: 19/086,000

(22) Filed: Mar. 20, 2025

Related U.S. Application Data

(63) Continuation of application No. PCT/CN2025/081474, filed on Mar. 8, 2025.

(51) Int. Cl.
*A43C 7/00* (2006.01)
*A43C 1/06* (2006.01)
*B65H 75/44* (2006.01)

(52) U.S. Cl.
CPC ..... *A43C 7/00* (2013.01); *A43C 1/06* (2013.01); *B65H 75/4471* (2013.01); *B65H 75/4492* (2013.01); *B65H 2701/31* (2013.01)

(58) Field of Classification Search
CPC ..... A43C 7/00; A43C 1/06; B65H 75/4471; B65H 75/4492; B65H 2701/31
See application file for complete search history.

(56) References Cited

U.S. PATENT DOCUMENTS

| | | | | |
|---|---|---|---|---|
| 11,849,809 | B1 * | 12/2023 | Xiang | A43C 11/165 |
| 12,295,460 | B2 * | 5/2025 | Soderberg | A43C 11/165 |
| 2013/0092780 | A1 * | 4/2013 | Soderberg | A43C 11/165 242/397 |
| 2017/0303643 | A1 * | 10/2017 | Converse | A43C 11/00 |
| 2020/0346888 | A1 * | 11/2020 | Kruse | A43B 23/0205 |
| 2022/0175089 | A1 * | 6/2022 | Pollack | A43C 11/165 |
| 2024/0375910 | A1 * | 11/2024 | Pollack | B65H 75/4492 |

* cited by examiner

*Primary Examiner* — David M Upchurch
(74) *Attorney, Agent, or Firm* — HOWARD M COHN and Associates, LLC

(57) ABSTRACT

A lace tightening and loosening device, wearable clothing, and a storage device are provided. The lace tightening and loosening device includes a base, a spool, a pawl disc, a dial and a connecting structure. When the dial is rotated in a first direction, the driving member drives the pawl disc to rotate in the first direction and drive the connecting structure to rotate, thereby driving the spool to rotate in the first direction to tighten a lace; when the dial is rotated in a second direction opposite to the first direction, the driving member drives the pawl to be separated from the first meshing part, so that the pawl disc rotates in the second direction and drives the connection structure to rotate.

13 Claims, 17 Drawing Sheets

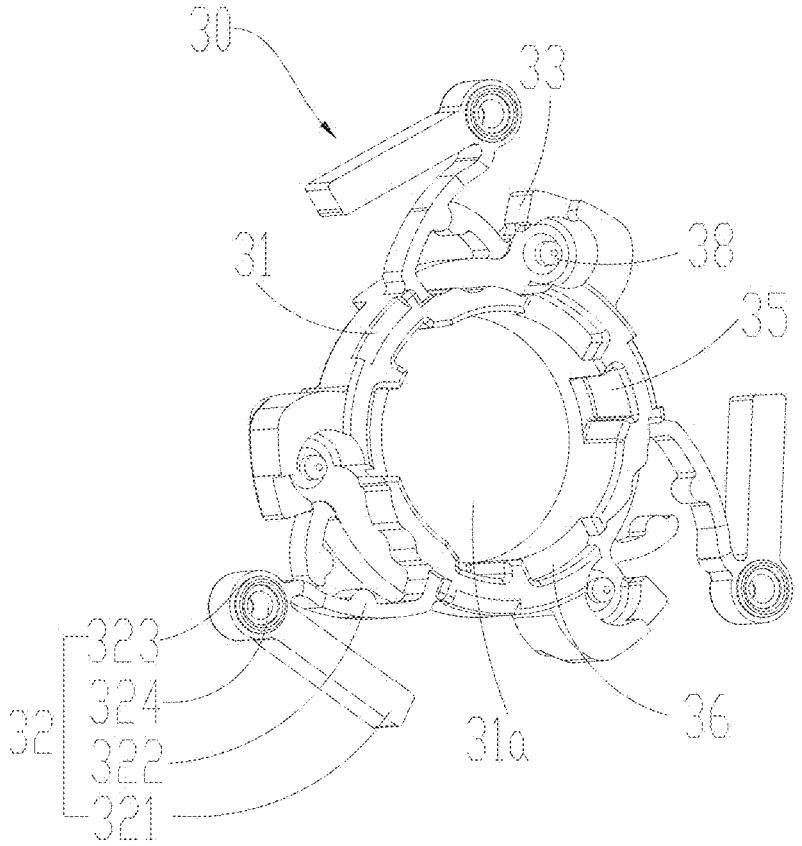
FIG. 13
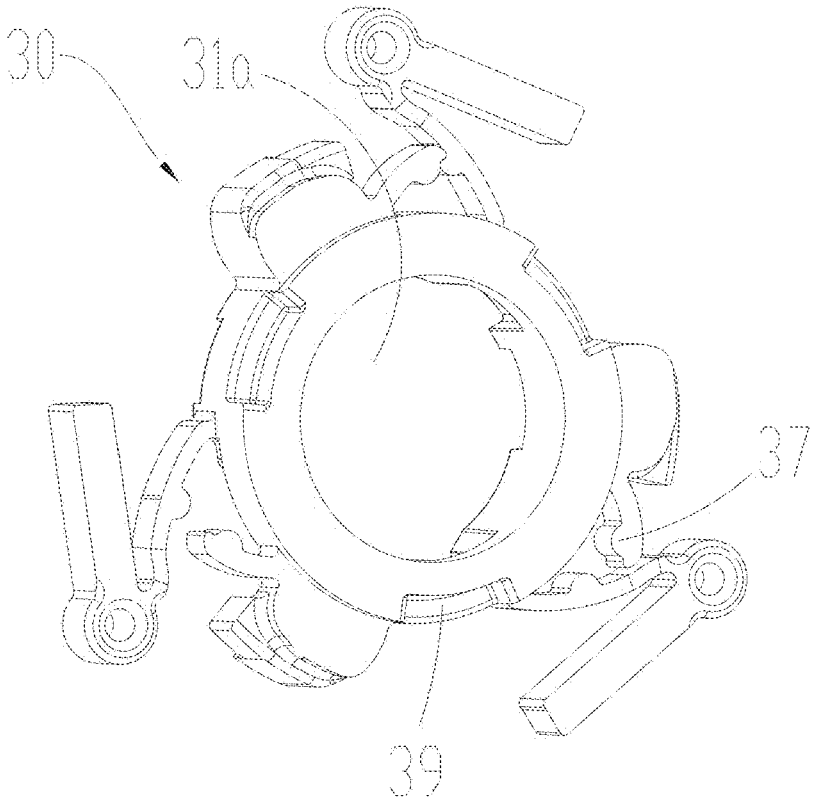

FIG. 16
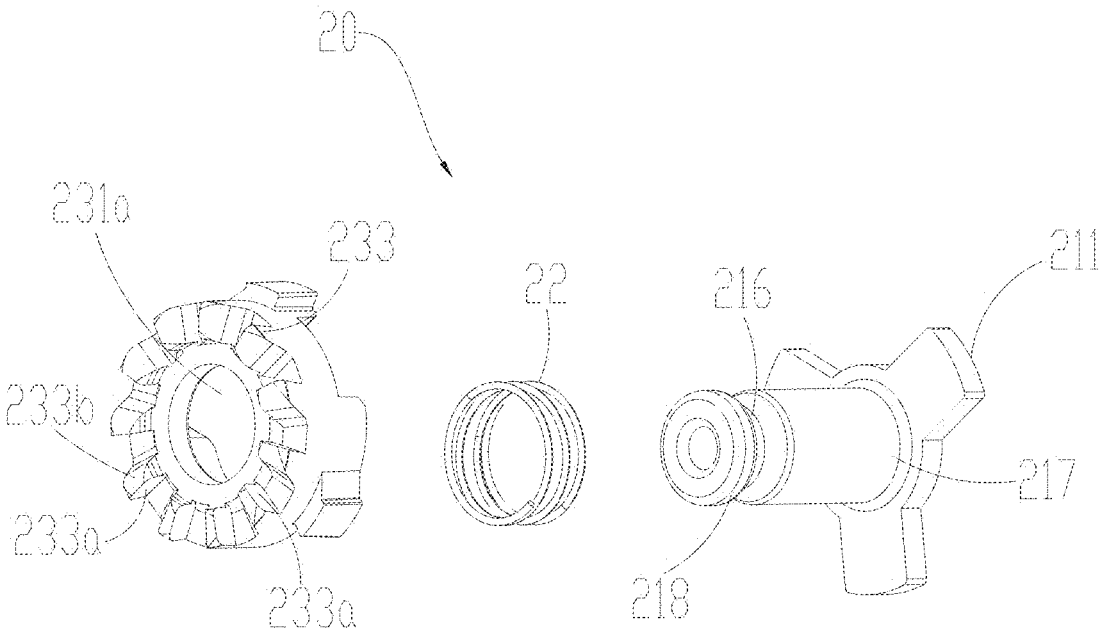
FIG. 17
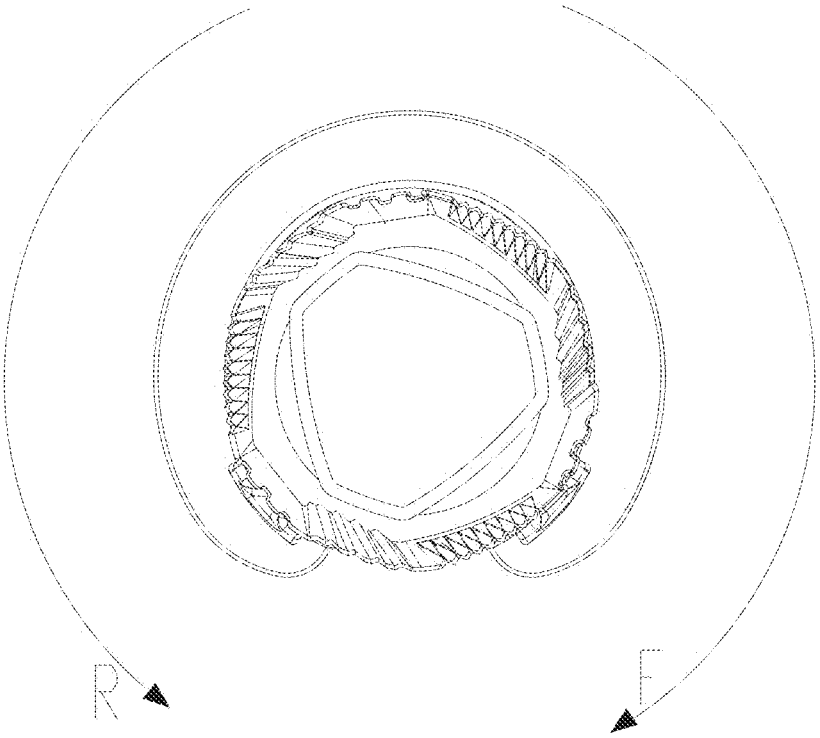
FIG. 18

PAWL DISC, LACE TIGHTENING AND LOOSENING DEVICE, WEARABLE CLOTHING, AND STORAGE DEVICE

CROSS-REFERENCE TO RELATED APPLICATIONS

This application is a continuation of International Application No. PCT/CN2025/081474, filed on Mar. 8, 2025, the entire content of which is incorporated herein by reference.

TECHNICAL FIELD

The present invention relates to a pawl disc, a lace tightening and loosening device, wearable clothing, and a storage device.

BACKGROUND

In order to make some articles for daily use suitable for different users, many articles for daily use are designed with draw laces, such as sneakers, hats, sports shirts, and gloves. The tightness of an article is adjusted by knotting the draw lace, but in daily life, the knotted draw lace is sometimes easily loosened and untied. If shoelaces are loosened, the shoelaces easily get dirty and trip over a user, and the like, especially for young children who cannot tie laces by oneself. It is very inconvenient for the elderly to bend over to tie laces because of poor health, which easily causes danger.

A lace loosening device in the current market can tighten and loosen a lace. For example, when the lace loosening device is used on a shoe, it is convenient for a user to put on and take off the shoe. However, when this lace loosening device loosens a lace, the lace needs to be completely loosened. As a result, during use, when a user feels uncomfortable if a lace is excessively tightened, the user has to completely loosen the lace and then tighten the lace to an appropriate extent. The user experience is poor.

SUMMARY

In order to solve the technical problem, the present invention provides a lace tightening and loosening device, wearable clothing, and a storage device.

In a first aspect, the present invention provides a lace tightening and loosening device, which includes a housing, a spool, a pawl disc, a dial and a connecting structure.

The housing includes a barrel-shaped main body, a first meshing part arranged on an inner side of the barrel-shaped main body, a partition plate arranged on the inner side of the barrel-shaped main body, and a first threading hole penetrating through the barrel-shaped main body.

The spool is arranged inside the barrel-shaped main body and includes a first base plate, a second base plate, and a side wall connecting the first base plate to the second base plate. The first base plate is opposite to the second base plate; the first base plate resists against the partition plate, and the second base plate is located on one side of the first base plate away from the partition plate; the first base plate, the second base plate, and the side wall form a winding region for storing a lace; the side wall is provided with a second threading hole that penetrates through the side wall.

The pawl disc is arranged on one side of the first base plate away from the second base plate and includes a substrate with a first through hole, a pawl connected to the substrate, and a first clamping part arranged on the substrate. The pawl is configured to be meshed with the first meshing part.

The dial is arranged on one side of the pawl disc away from the spool and includes a cover plate, a side plate connected to one side of the cover plate, a driving member arranged on one side of the cover plate facing the side plate, and a second clamping part arranged on one side of the cover plate facing the side plate. The cover plate and the side plate are enclosed to form an accommodating cavity with an opening; a portion of the barrel-shaped main body is located in the accommodating cavity; the second clamping part is clamped with the first clamping part.

The connecting structure is arranged in the first through hole in a penetrating manner and connecting the pawl disc to the spool. The connecting structure is movably connected to the spool.

When the dial is rotated in a first direction, the driving member drives the pawl disc to rotate in the first direction and drive the connecting structure to rotate, thereby driving the spool to rotate in the first direction to tighten a lace; when the dial is rotated in a second direction opposite to the first direction, the driving member drives the pawl to be separated from the first meshing part, so that the pawl disc rotates in the second direction and drives the connection structure to rotate; meanwhile, under an external force, the lace drives the spool to rotate in the second direction and be loosened from the spool; when no external force is applied, the spool stops rotating; when the dial is lifted axially away from the housing under an external force, the pawl disc and the connecting structure are away from the spool, so that the lace is completely loosened from the spool under the external force.

Preferably, the connecting structure includes a connecting piece arranged in the first through hole; the connecting piece includes a main body part, a connecting block arranged at the main body part, and a first tooth arranged at one end of the main body part; the pawl disc further includes a connecting slot extending in an axial direction of the substrate; the connecting slot is communicated to the first through hole; the connecting block is arranged in the connecting slot and slides along the connecting slot; a second tooth is arranged on one side of the first base plate away from the second base plate; and the second tooth is configured to be meshed with the first tooth, so that the connecting piece pushes the spool to rotate in the first direction, and the connecting piece rotates in the second direction to be demeshed from the spool.

Preferably, the first tooth includes a first inclined surface and a first arc-shaped surface facing away from the first inclined surface; the second tooth includes a second inclined surface and a second arc-shaped surface facing away from the second inclined surface; the first inclined surface is configured to resist against the second inclined surface, which enables the connecting piece to push the spool to rotate in the first direction; and the first arc-shaped surface is configured to resist against the second arc-shaped surface, which enables the connecting piece to rotate in the second direction and be demeshed from the spool.

Preferably, the connecting structure further includes a positioning member and an elastic member; the positioning member includes a connecting plate and a post connected to the connecting plate; the connecting plate is provided with a first connecting part; the post is arranged in the first through hole in a penetrating manner; the substrate of the pawl disc is provided with a second connecting part; the first connecting part is connected to the second connecting part;

the elastic member sleeves the post; the connecting piece is provided with a second through hole; the post is arranged in the second through hole in a penetrating manner; the connecting piece is provided with a resisting surface on one side away from the first base plate; and one end of the elastic member resists against the resisting surface, and the other end resists against the connecting plate to reset the connecting piece.

Preferably, the post includes a first end portion and a second end portion opposite to the first end portion; the first end portion is connected to the connecting plate; the post is provided with an annular groove in one end close to the second end portion; a bulge is arranged on the spool; the bulge is arranged in the groove; the second end portion is located on one side of the bulge away from the first end portion; the bulge slides in a circumferential direction of the groove; the post moves in the axial direction to separate the groove from the bulge, and the second end portion resists against one side of the bulge facing the first end portion; the dial is provided with a first positioning part; the connecting plate is provided with a second positioning part on one side away from the post; and the first positioning part is connected to the second positioning part.

Preferably, the spool includes a third through hole penetrating through the first base plate and the second base plate; the post is arranged in the third through hole in a penetrating manner; the spool includes a wall plate; the wall plate is connected to the first base plate and extends towards the second base plate; a hole wall of the third through hole includes the wall plate; the bulge is arranged on one side of the wall plate facing the third through hole; the spool further includes an open slot; the open slot covers the second base plate and extends towards the first base plate; and the open slot is communicated to the second threading hole.

Preferably, the housing further includes a limiting structure; the limiting structure is arranged on one side of the housing away from the dial and resists against the second base plate to limit the spool inside the barrel-shaped main body; the second base plate is provided with a plurality of damping members on one side away from the first base plate; the plurality of damping members are arranged around an edge of the second base plate; the damping members are configured to generate resistance when resisting against the limiting structure; and a force that rotates the spool is greater than the resistance, the spool is rotated relative to the housing.

Preferably, the pawl disc further includes a resistance arm arranged on one side of the substrate away from the dial; the resistance arm has an elasticity to resist against the driving member to provide a resistance; when the dial is rotated in the second direction, and a force applied by the driving member to drive the resistance arm is greater than or equal to the resistance, the pawl disc is rotated in the second direction.

Preferably, the pawl includes an elastic arm connected to the substrate, a second meshing part for being meshed with the first meshing part, and a cylinder connected to the elastic arm and the second meshing part; the cylinder is provided with a connecting hole; a connecting column is arranged on one side of the substrate facing the dial; the connecting hole sleeves the connecting column; the pawl disc further includes a resisting part; the resisting part is arranged on an outer side of the substrate and is adjacent to the connecting column; when the dial is rotated in the first direction, the driving member resists against the resisting part to drive the pawl disc to rotate in the first direction; when the dial is rotated in the second direction, the driving member resists against the second meshing part and moves in a radial direction of the pawl disc; and the cylinder is rotated around the connecting column until the second meshing part is separated from the first meshing part.

Preferably, the dial further includes a first snap; the first snap is arranged on an inner side of the side wall; the housing is provided with a second snap; the second snap is arranged on an outer side of the barrel-shaped main body; and the first snap is configured to be fastened with the second snap to prevent the dial from being separated from the housing.

Preferably, the lace tightening and loosening device further includes a chassis for placing the lace tightening and loosening device on an external object, the chassis is arranged at one end of the housing away from the dial; the housing further includes a third snap and a fourth snap; the housing is provided with a fifth snap and a sixth snap; and the third snap and the fourth snap are respectively fastened with the fifth snap and the sixth snap.

In a second aspect, the present invention also provides a wearable clothing, which includes a first part, a second part, and a lace, further includes the lace tightening and loosening device described above. The lace tightening and loosening device is configured to tighten or loosen the lace to tighten or loosen the first part and the second part, thereby fixing the wearable clothing onto a human body part; and the wearable clothing includes one of a shoe, a hat, a glove, a medical protective gear, a helmet, a skiing protective gear, and clothes.

In a third aspect, the present invention also provides a storage device, which includes a first part, a second part, and a lace, further including the lace tightening and loosening device described above. The lace tightening and loosening device is configured to tighten or loosen the lace to tighten or loosen the first part and the second part, thereby storing or removing an object into or from the storage device.

In a fourth aspect, the present invention also provides a pawl disc, applied to a lace tightening and loosening device. The pawl disc includes an annular hollow substrate, and a pawl arranged on the substrate; the pawl includes an elastic arm connected to the substrate, and a second meshing part connected to the elastic arm and configured to be meshed with the lace tightening and loosening device; the second meshing part is located at one end of the elastic arm away from the substrate; and the second meshing part is detachably connected to the substrate.

Preferably, the pawl further includes a cylinder arranged between the elastic arm and the second meshing part; a connecting column is arranged on the substrate; a connecting hole is provided in the cylinder; the pawl disc is integrally formed; and the cylinder and the connecting column are detachably connected through the connecting hole.

Compared with the prior art, the pawl disc provided in the present invention is integrally formed, and the cylinder and the connecting column can be detachably connected. After production and manufacturing, during mounting and use, only the cylinder needs to be mounted on the connecting column, which effectively reduces a quantity of parts that achieve a function of the pawl disc, and ensuring the strength of the pawl disc, so that it is convenient for production and manufacturing of the pawl disc, thereby reducing the production costs. The lace tightening and loosening device provided in the present invention can rotate the dial in the first direction to drive the spool to tighten the lace. When the dial is rotated in the second direction to separate the pawl disc and the connecting structure from the spool. The lace can be loosened when an external force is applied to the spool. When no external force is applied to the lace, the spool remains stationary, and when the dial is further rotated in the second direction, the dial, the pawl disc, and the connecting structure remain idling, so that the spool cannot be pushed to rotate in the second direction, thereby ensuring that the lace is not squeezed out, avoiding a situation such as loosening or knotting of the lace inside the spool, and then ensuring the service life of the product. Since the second clamping part with the first clamping part are clamped, the dial is connected to the pawl disc. Therefore, when the dial is lifted, the pawl disc and the connecting structure are also lifted, so that the connecting structure is separated from the spool. This makes the lace drive the spool to rotate in the second direction under the external force, to completely loosen the lace.

BRIEF DESCRIPTION OF THE DRAWINGS

In order to explain the technical solutions of the embodiments of the present invention more clearly, the following will briefly introduce the accompanying drawings used in the embodiments. Apparently, the drawings in the following description are only some embodiments of the present invention. Those of ordinary skill in the art can obtain other drawings based on these drawings without creative work.

FIG. 13 is a schematic diagram of an initial state of the pawl disc of the lace tightening and loosening device shown in FIG. 11;

FIG. 16 is a schematic diagram of a connecting structure of the lace tightening and loosening device shown in FIG. 1;

FIG. 17 is a schematic diagram of a connecting piece of the connecting structure shown in FIG. 16;

FIG. 18 is a schematic diagram of a rotation direction of a lace tightening and loosening device according to an embodiment of the present invention;

DETAILED DESCRIPTION OF THE EMBODIMENTS

The technical solutions in the embodiments of the present invention will be clearly and completely described below in conjunction with the accompanying drawings in the embodiments of the present invention. Apparently, the described embodiments are only a part of the embodiments of the present invention, rather than all the embodiments. Based on the embodiments in the present invention, all other embodiments obtained by those ordinarily skilled in the art without doing creative work shall fall within the protection scope of the present invention.

To make the aforementioned objectives, features, and advantages of the present invention more comprehensible, specific implementations of the present invention are described in detail below in conjunction with the accompanying drawings.

In order to make a person skilled in the art to better understand the solutions of the present invention, the technical solutions in the embodiments of the present invention are described below with reference to the accompanying drawings in the embodiments of the present invention the described embodiments are merely some rather than all of the embodiments of the present invention. The embodiments in the present invention shall all fall within the protection scope of the present invention.

The terms "first", "second" and "third" in the specification and claim of the present invention and the attached drawings are used to distinguish different objects rather than to describe a specific sequence. Furthermore, the term "includes", and any variation thereof, is intended to cover non-exclusive inclusion. For example, a process, method, system, product or device comprising a series of steps or units is not limited to the listed steps or units, but optionally also includes steps or units not listed, or optionally includes other steps or units inherent to those processes, methods, products or devices.

Figure 1:
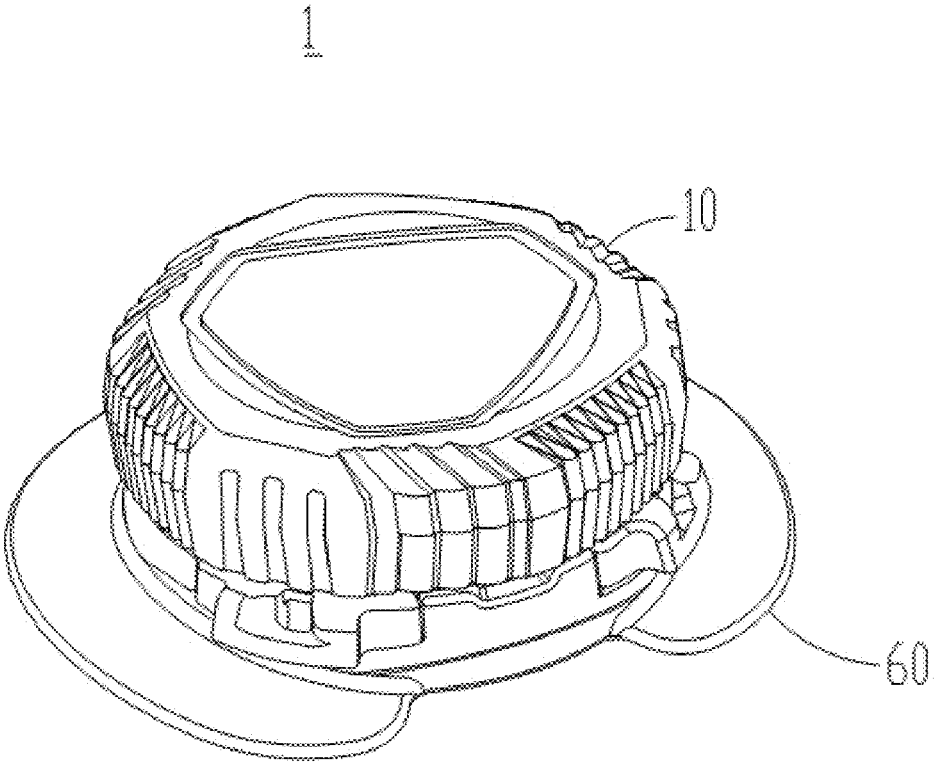
FIG. 1 is a three-dimensional diagram of a lace tightening and loosening device according to an embodiment of the present invention.
Figure 2:
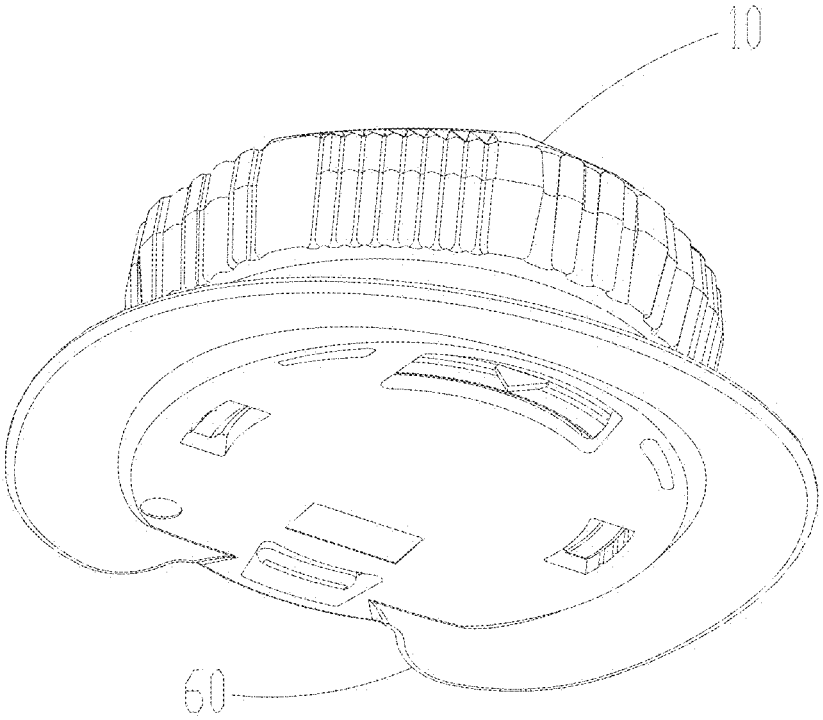
FIG. 2 is a three-dimensional diagram of a lace tightening and loosening device according to an embodiment of the present invention, viewed in another angle.

Referring to FIG. 1 and FIG. 2, an embodiment of the present invention provides a lace tightening and loosening device 1, configured to tighten and loosen a lace. Specifically, referring to FIG. 3 and FIG. 4, the lace tightening and loosening device 1 includes a dial 10, a connecting structure 20, a pawl disc 30, a spool 50, a housing 40, and a chassis 60. The dial 10 is connected to the housing 40. The connecting structure 20, the pawl disc 30, and the spool 50 are all located in a space enclosed by the dial 10 and the housing 40. The chassis 60 is located at one end of the housing 40 away from the dial 10, to place the lace tightening and loosening device 1 on an object, such as a shoe 2, a hat 3, a glove 4, a medical protective gear 5, a helmet, a storage device 6, a skiing protective gear, a bag, and clothes.

Figure 5:
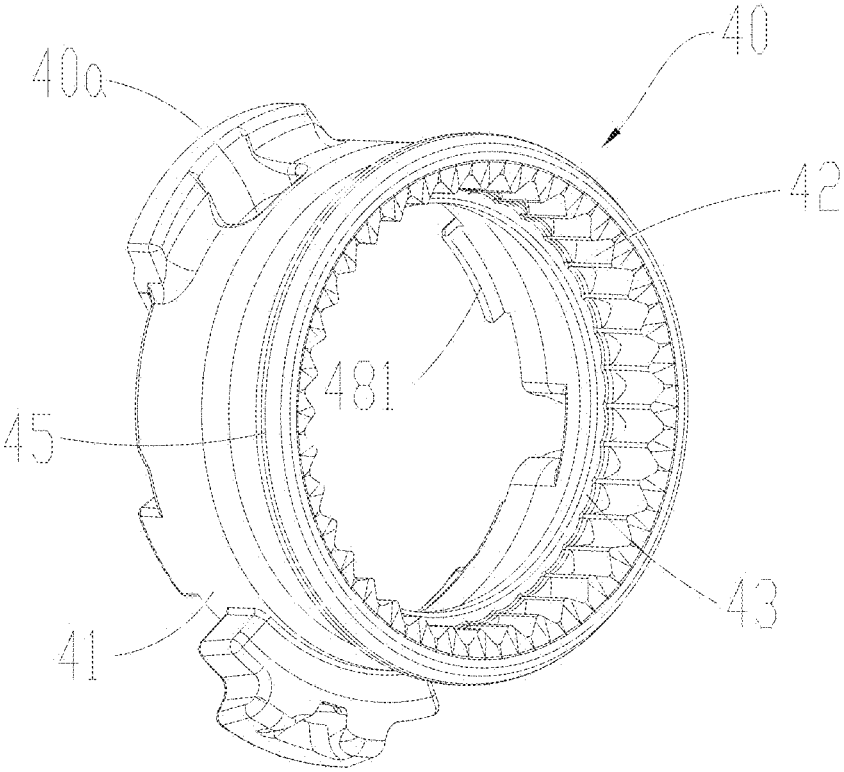
FIG. 5 is a schematic diagram of a housing of the lace tightening and loosening device shown in FIG. 1.

Referring to FIG. 5, the housing 40 includes a barrel-shaped main body 41, a first meshing part 42 arranged on an inner side of the barrel-shaped main body 41, a partition plate 43 arranged on the inner side of the barrel-shaped main body 41, and a first threading hole 40*a* penetrating through the barrel-shaped main body 41. It can be understood that the barrel-shaped main body 41 is internally hollow and has openings in two ends. The first meshing part 42 is a shuttle annularly arranged on an inner wall of the barrel-shaped main body 41 and is formed by connecting a plurality of meshing teeth. The partition plate 43 is located at a substantially middle position of the barrel-shaped main body 41. The first meshing part 42 and the first threading hole 40*a* are respectively located at two end portions of the barrel-shaped main body 41.

The spool 50 is arranged inside the barrel-shaped main body 41. Specifically, referring to FIG. 7, the spool 50 includes a first base plate 51, a second base plate 52, and a side wall 53 connecting the first base plate 51 to the second base plate 52. The first base plate 51 is opposite to the second base plate 52. The first base plate 51 resists against the partition plate 43, and the second base plate 52 is located on one side of the first base plate 51 away from the partition plate 43. The first base plate 51, the second base plate 52, and the side wall 53 form a winding region 50*a* for storing a lace. The side wall 53 is provided with a second threading hole 50*b* that penetrates through the side wall 53. An overall appearance of the spool 50 is "I"-shaped, which is convenient for storing a lace. Specifically, the spool 50 is arranged at one end of the partition plate 43 away from the first meshing part 42, and the first threading hole 40*a* and the second threading hole 50*b* can be communicated to each other in an overlapping manner to allow the lace to pass through.

The pawl disc 30 is arranged on one side of the first base plate 51 away from the second base plate 52. Specifically, referring to FIG. 11 and FIG. 12, the pawl disc 30 includes a substrate 31 with a first through hole 31*a*, a pawl 32 connected to the substrate 31, and a first clamping part 39 arranged on the substrate 31. The pawl 32 is configured to be meshed with the first meshing part 42. Specifically, the pawl disc 30 is located on one side, away from the spool 50, of the partition plate 43 located inside the barrel-shaped main body 41, so that the pawl 32 can be meshed with the first meshing part 42. The pawl 32 can be meshed with or demeshed from the first meshing part 42. When the pawl 32 is meshed with the first meshing part 42, the pawl 32 can be separated from the first meshing part 42 in a first direction F. When the pawl 32 is rotated in a second direction R opposite to the first direction F, the first meshing part 42 blocks the rotation of the pawl 32, thereby preventing the pawl disc 30 from rotating in the second direction R. If the pawl disc 30 needs to be rotated in the second direction R, the pawl 32 needs to be separated from the first meshing part 42.

Figure 15:
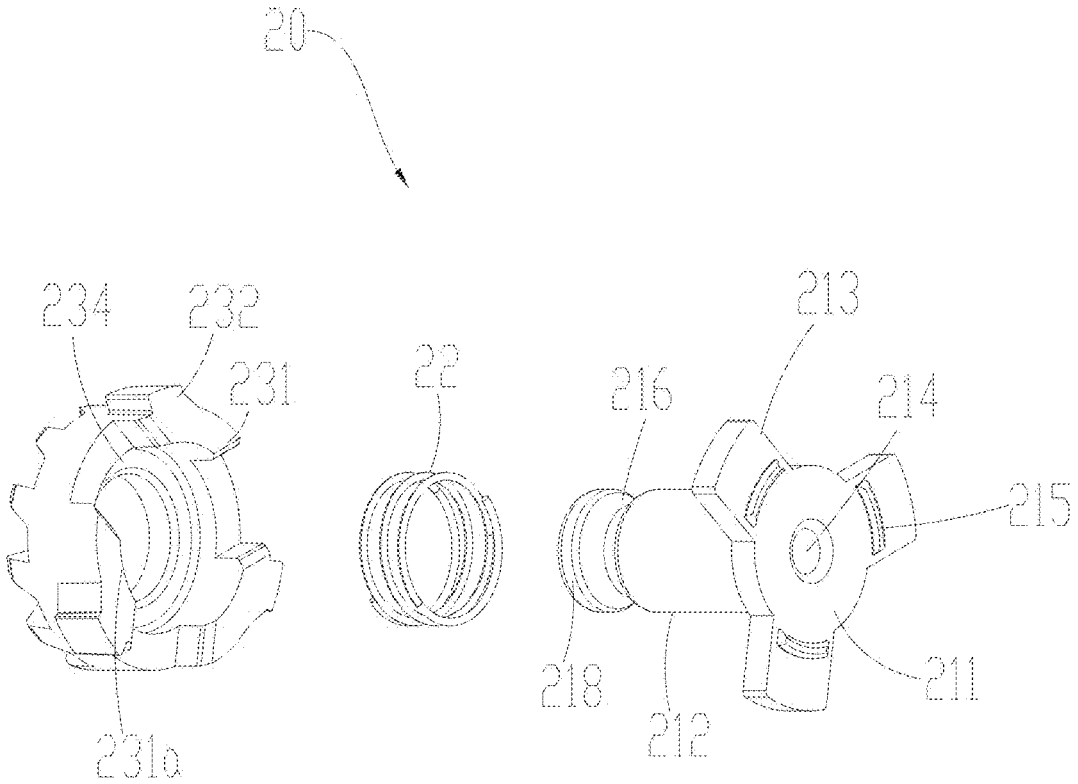
FIG. 15 is a schematic diagram of a dial of the lace tightening and loosening device shown in FIG. 1.

The dial 10 is arranged on one side of the pawl disc 30 away from the spool 50. Specifically, referring to FIG. 15, the dial 10 includes a cover plate 11, a side plate 12 connected to one side of the cover plate 11, a driving member 13 arranged on one side of the cover plate 11 facing the side plate 12, and a second clamping part 14 arranged on one side of the cover plate 11 facing the side plate 12. Specifically, the dial 10 is of a roughly cylindrical structure. The cover plate 11 and the side plate 12 are enclosed to form an accommodating cavity 10*a* with an opening, and a portion of the barrel-shaped main body 41 is located in the accommodating cavity 10*a*. In this embodiment, the driving member 13 and the second clamping part 14 are both arranged inside the accommodating cavity 10*a*. It can be understood that the dial 10 is covered at the housing 40, so that the spool 50 and the pawl disc 30 are both located inside the barrel-shaped main body 41, thereby achieving a protective effect on the spool 50 and the pawl disc 30.

Referring to FIG. 3 to FIG. 6, a limiting structure 48 for resisting connection to limit the spool 50 inside the barrel-shaped main body 41 is arranged on one side of the housing 40 away from the dial 10. The limiting structure 48 includes a first limiting member 481 and a second limiting member 482. The first limiting member 481 and the second limiting member 482 resist against one side of the second base plate 52 of the spool 50 away from the first base plate 51, to limit the spool 50 inside the barrel-shaped main body 41, thereby preventing the spool 50 from being separated from the housing 40, and then ensuring that the connecting structure 20, the pawl disc 30, and the spool 50 are located between the dial 10 and the housing 40 to achieve linkage of the components. The first limiting member 481 and the second limiting member 482 are opposite to each other on the second base plate 52. The chassis 60 is located at one end of the housing 40 away from the dial 10.

In this embodiment, the second clamping part 14 is clamped with the first clamping part 39. Specifically, the second clamping part 14 is a hook, and the first clamping part 39 is a groove provided in one side of the base plate away from the dial 10. The hook is hooked with a wall of the groove, thereby connecting the pawl disc 30 to the dial 10 in an axial direction. In this design, when the dial 10 is lifted, the pawl disc 30 can be lifted too through the first clamping part 39 and the second clamping part 14. When the second clamping part 14 is clamped with the first clamping part 39, if the dial 10 is rotated, the second clamping part 14 can move inside the first clamping part 39.

The connecting structure 20 is located inside the barrel-shaped main body 41 and the dial 10, is arranged in the first through hole 31*a* in a penetrating manner, and connects the pawl disc 30 to the spool 50. The connecting structure 20 is movably connected to the spool 50.

The lace tightening and loosening device 1 provided in the present invention has three use functions: tightening a lace, finely adjusting and loosening the lace, and completely loosening the lace. In this embodiment, the dial 10 can be rotated in the first direction F and the second direction R, and can be further lifted in the axial direction. Namely, the dial 10 can move in the axial direction towards one side away from the housing 40. The first direction F and the second direction R are opposite directions. Referring to FIG. 18, in this embodiment, using a direction in which the dial 10 faces the housing 40 as an observation angle, using the first direction F as a clockwise direction, and using the second direction R as a counterclockwise direction are taken for example.

Figure 19:
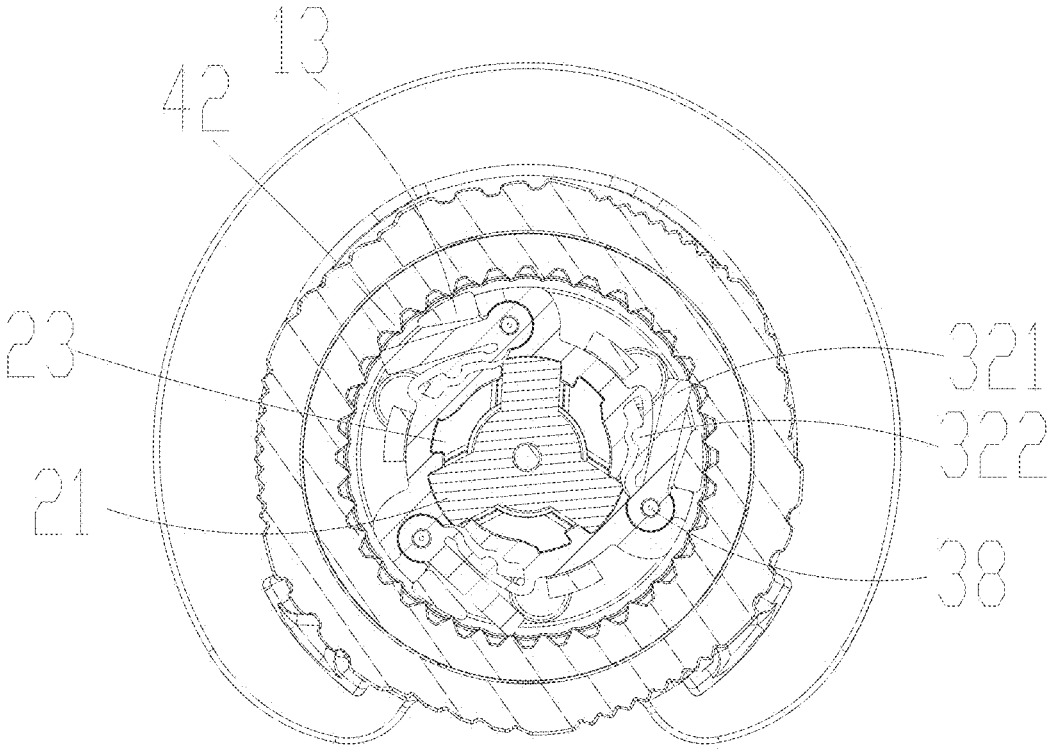
FIG. 19 is a sectional view of a lace tightening and loosening device that rotates in a first direction according to an embodiment of the present invention.

Referring to FIG. 19, when the lace needs to be tightened, the dial 10 is rotated in the first direction F, which drives the driving member 13 to drive the pawl disc 30 to rotate in the first direction F. In this case, the pawl 32 is separated from the first meshing part 42, which can push the pawl disc 30 to rotate in the first direction F and drive the connecting structure 20 to rotate, thereby driving the spool 50 to rotate in the first direction F to tighten the lace.

Figure 21:
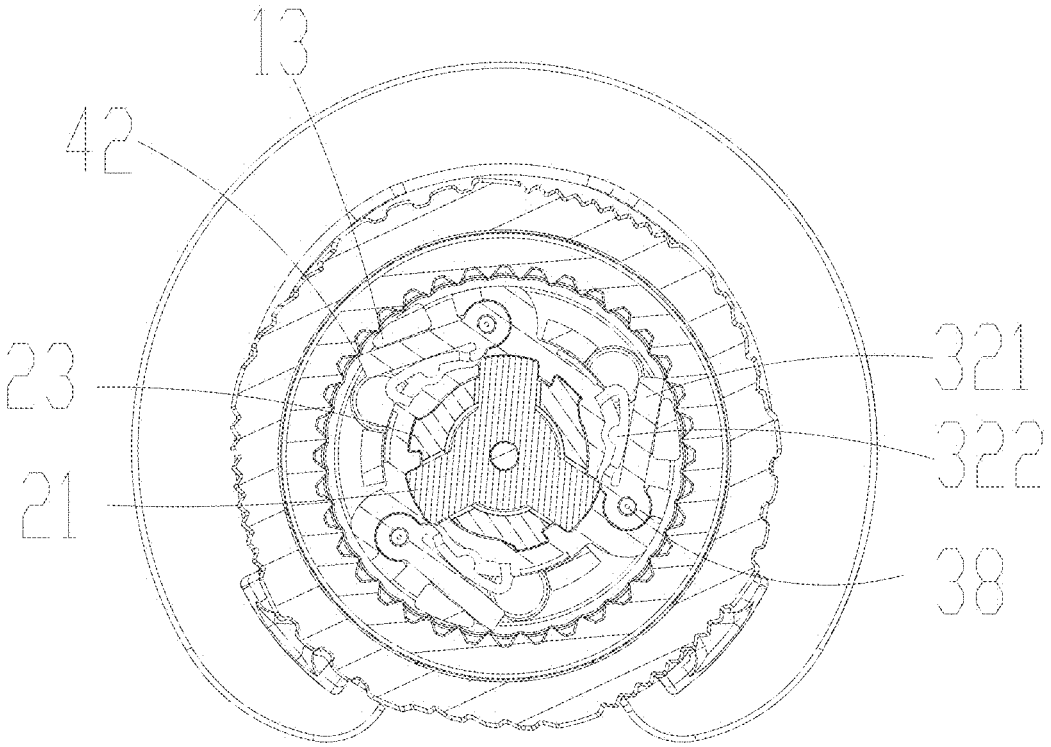
FIG. 21 is a sectional view of a lace tightening and loosening device that rotates in a second direction according to an embodiment of the present invention.

Referring to FIG. 21, when the lace needs to be finely adjusted and loosened, the dial 10 is rotated in the second direction R opposite to the first direction F. The driving member 13 drives the pawl 32 to be separated from the first meshing part 42, so that the pawl disc 30 can be rotated in the second direction R and drive the connecting structure 20 to rotate. In this case, under an external force, the lace can drive the spool 50 to rotate in the second direction R and be loosened from the spool 50. When there is no external force, the spool 50 stops rotating, thus achieving fine adjustment on loosening of the lace.

Figure 23:
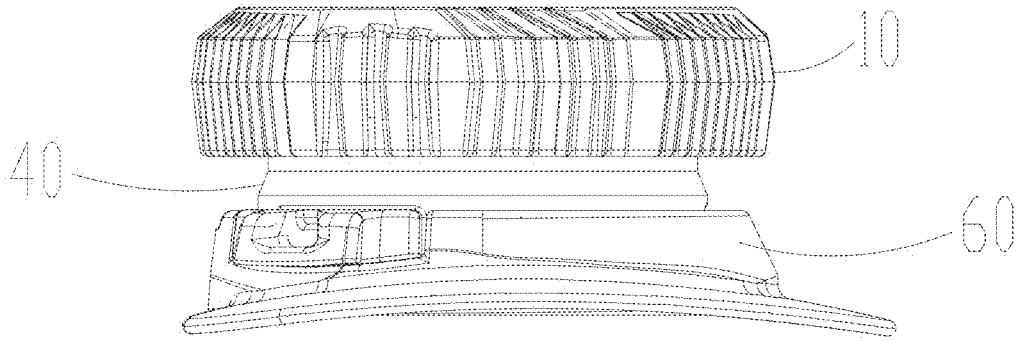
FIG. 23 is a schematic diagram of a state of completely loosening a lace of a lace tightening and loosening device according to an embodiment of the present invention.
Figure 24:
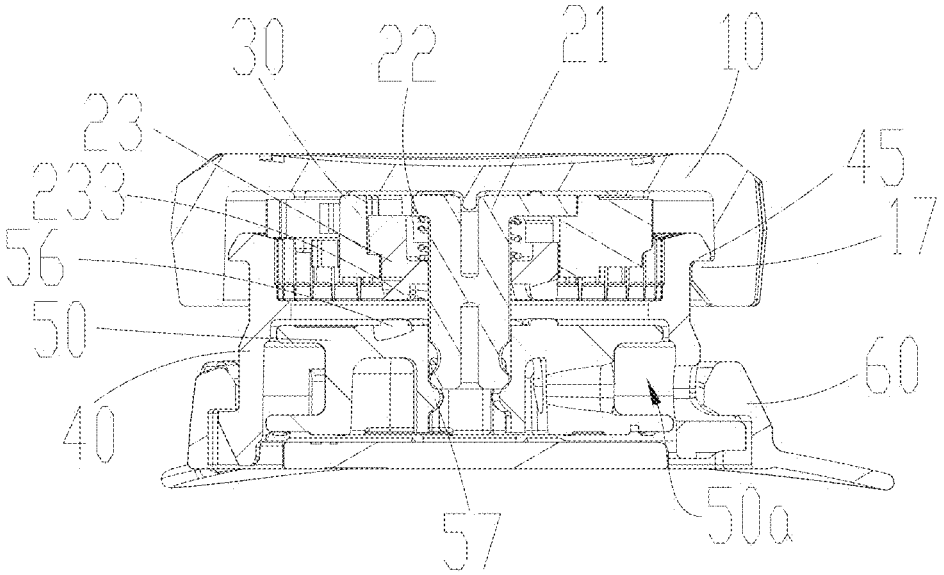
FIG. 24 is a sectional view of a state of completely loosening a lace of a lace tightening and loosening device according to an embodiment of the present invention.

Referring to FIG. 23 and FIG. 24, when the lace needs to be completely loosened, the dial 10 is lifted in the axial direction under an external force to move away from the housing 40, and the pawl disc 30 and the connecting structure 20 move away from the spool 50. In this case, the connecting structure 20 is separated from the spool 50, and the spool 50 can fspooly rotate inside the housing 40 under the external force, so that the spool 50 can completely loosen the lace under the external force.

Specifically, referring to FIG. 27 to FIG. 30, a schematic diagram of use of the lace tightening and loosening device 1 to an object is shown. When the lace tightening and loosening device 1 is used, the lace tightening and loosening device 1 is applied to wearable clothing such as a shoe 2, a hat 3, a glove 4, a medical protective gear 5, a helmet, a skiing protective gear, and clothes. The dial 10 is rotated in the first direction F to tighten the lace, thereby tightening the wearable clothing and fixing the wearable clothing to a human body part such as the head, an arm, a hand, a foot, or the body. However, when the dial 10 is rotated too much, the lace may be strained. In this case, the lace has a tension, which reduces the comfort level of a user. It is necessary to finely adjust and loosen part of the lace. The dial 10 is rotated in the second direction R, so that the connecting structure 20 can be temporarily separated from the spool 50, to drive, under the tension of the lace, the spool 50 to rotate in the second direction R, thereby loosening the lace. When the lace is adjusted appropriately, the rotation on the dial is stopped, and the spool 50 stops rotating, thereby stopping the loosening of the lace and making the product experience better. There is no need to completely loosen the lace and then tighten the lace again. When the lace needs to be completely loosened to remove the wearable clothing from the human body part, the dial 10 is lifted, and the lace is pulled to be completely loosened, so that the wearable clothing is loosened and separated from the human body part.

Figure 31:
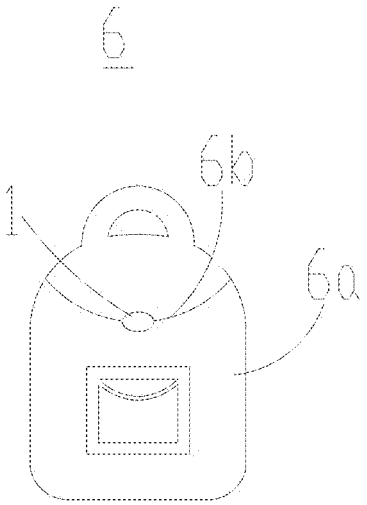
FIG. 31 is a schematic structural diagram of a storage device according to an embodiment of the present invention.

Referring to FIG. 31, a schematic diagram of use of the lace tightening and loosening device 1 in a storage device is shown. When the lace tightening and loosening device 1 is used, the lace tightening and loosening device 1 is applied to a storage device 6 such as a bag, a backpack, and a storage box. The dial 10 is rotated in the first direction F to tighten the lace, thereby tightening an opening of the storage device 6 and storing an object inside the storage device 6. However, when the dial 10 is rotated too much, the lace may be strained. In this case, the lace has a tension, which makes the storage device 6 deform or the lace excessively strained. It is necessary to finely adjust and loosen part of the lace. The dial 10 is rotated in the second direction R, so that the connecting structure 20 can be temporarily separated from the spool 50, to drive, under the tension of the lace, the spool 50 to rotate in the second direction R, thereby loosening the lace. When the lace is adjusted appropriately, the rotation on the dial is stopped, and the spool 50 stops rotating, thereby stopping the loosening of the lace and causing the storage device 6 to have proper tightness during opening tightening. There is no need to completely loosen the lace and then tighten the lace again. When the storage device 6 needs to be opened to take out the object, the dial 10 is lifted, and the lace is pulled to be completely loosened, so that the storage device 6 is completely opened, and the object can be taken out of the storage device 6.

In this embodiment, two first threading holes 40*a* and two second threading holes 50*b* are included and are in one-to-one correspondence. Two ends of the lace respectively enter the second threading holes 50*b* through the first threading holes 40*a* and are knotted inside the spool 50, so that the lace can be fixed in the second threading holes 50*b*. Therefore, when the dial 10 is rotated in the first direction F to push the spool 50 to rotate, the lace can be tightened in the winding region 50*a*.

Referring to FIG. 16 and FIG. 17, the connecting structure 20 includes a positioning member 21, an elastic member 22, and a connecting piece 23. The positioning member 21 includes a connecting plate 211 and a post 212 connected to the connecting plate 211, and the elastic member 22 sleeves the post 212. The connecting piece 23 is provided with a second through hole 231*a*. The post 212 and the elastic member 22 are arranged in the second through hole 231*a* in a penetrating manner. The positioning member 21, the elastic member 22, and the connecting piece 23 are all arranged in the first through hole 31*a* in a penetrating manner.

In this embodiment, the pawl 32 includes an elastic arm 322 connected to the substrate 31, a second meshing part 321 for being meshed with the first meshing part 42, and a cylinder 323 connected to the elastic arm 322 and the second meshing part 321. The cylinder 323 is provided with a connecting hole 324. A connecting column 38 is arranged on one side of the substrate 31 facing the dial 10. The connecting hole 324 sleeves the connecting column 38. The pawl disc 30 further includes a resisting part 33. The resisting part 33 is arranged on an outer side of the substrate 31 and is adjacent to the connecting column 38. When the dial 10 is rotated in the first direction F, the driving member 13 resists against the resisting part 33 to drive the pawl disc 30 to rotate in the first direction F. When the dial 10 is rotated in the second direction R, the driving member 13 resists against the second meshing part 321 and moves in a radial direction of the pawl disc 30. The cylinder 323 rotates around the connecting column 38 until the second meshing part 321 is separated from the first meshing part 42.

Figure 20:
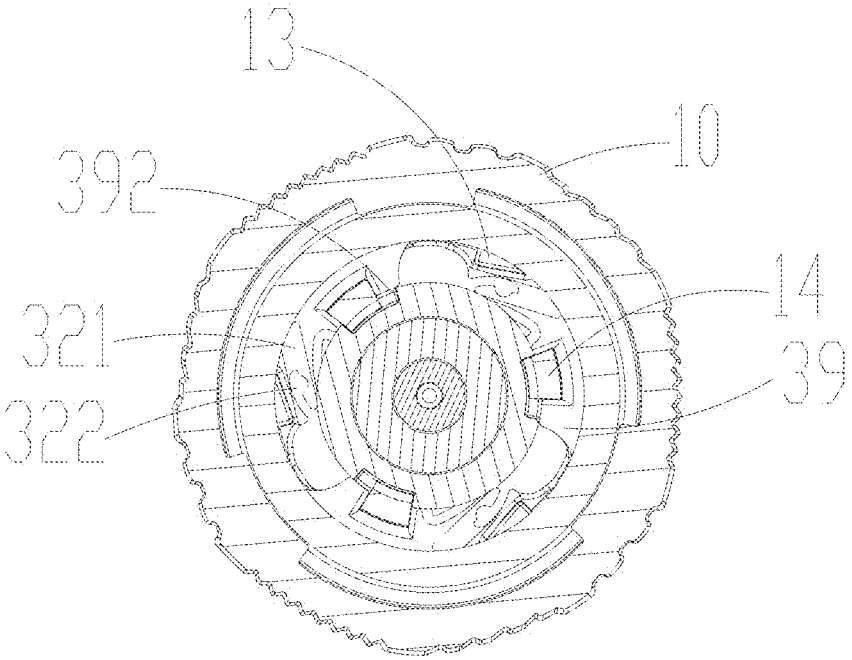
FIG. 20 is a sectional view of a lace tightening and loosening device that rotates in a first direction according to an embodiment of the present invention, viewed in another angle.
Figure 22:
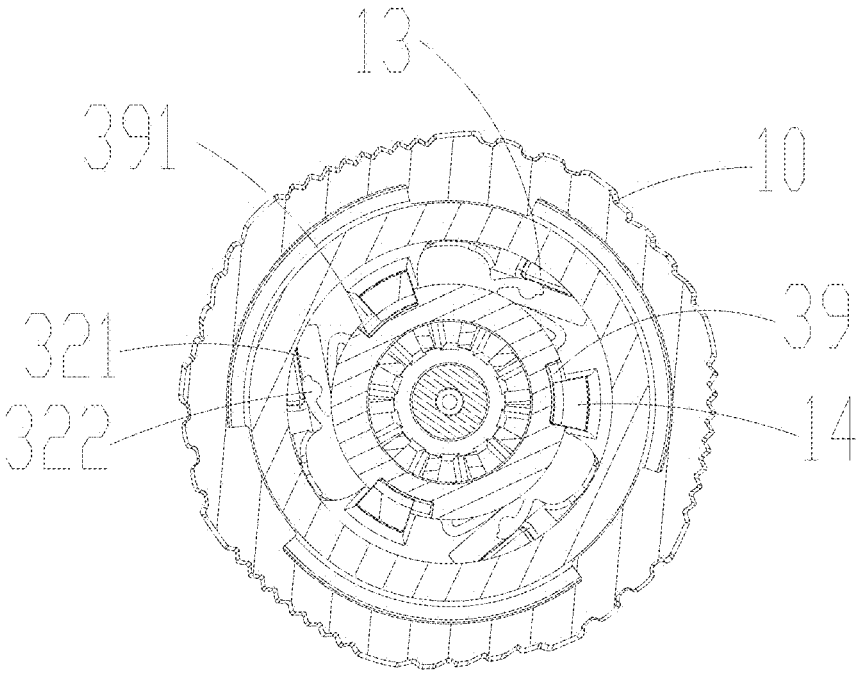
FIG. 22 is a sectional view of a lace tightening and loosening device that rotates in a second direction according to an embodiment of the present invention, viewed in another angle.

Specifically, the second clamping part 14 on the dial 10 uses a hook, and the corresponding first clamping part 39 on the pawl disc 30 uses a groove. A perimeter of the groove in a circumferential direction of the substrate 31 is greater than a perimeter of the hook inside the groove, so that the hook can move inside the groove in a length direction of the groove. In this way, when the dial 10 is rotated in the second direction R, the dial 10 and the pawl disc 30 can rotate relatively by an angle. Specifically, referring to FIG. 20, when the dial 10 is not rotated, the second clamping part 14 resists against one end surface of the first clamping part 39. This end surface is defined as a first end surface 391. At the beginning, the pawl 32 of the pawl disc 30 resists against the first meshing part 42 of the housing 40. When the dial 10 is rotated in the second direction R, the second clamping part 14 moves along the first clamping part 39 to another end surface of the first clamping part 39. This end surface is defined as a second end surface 392. In this case, the dial 10 is rotated relative to the pawl disc 30. When the dial 10 continues to be rotated in the second direction R, the second clamping part 14 resists against the second end surface 392 of the first clamping part 39, as shown in FIG. 22. In this case, the driving member 13 on the dial 10 presses the pawl 32 inwards in the radial direction of the pawl disc 30, so that the pawl 32 deforms towards a circle center and is separated from the first meshing part 42 of the housing 40, so that the dial 10 pushes the connecting structure 20 and the pawl disc 30 to rotate in the second direction R. In this case, the lace can drive the spool 50 to rotate in the second direction R under an external force and be loosened from the spool 50. When the dial 10 remains stationary or rotates without an external force, the pawl 32 resists against the driving member 13, so that the second clamping part 14 resists against the first end surface 391 of the first clamping part 39. In this case, when a user touches the dial 10, the user can feel the stability between the dial 10 and the pawl disc 30, without any sense of loosening caused by a gap.

To further prevent the pawl disc 30 from rotating in the second direction R when the dial 10 is accidentally touched, causing the spool 50 to rotate in the second direction R to loosen the lace, the pawl disc 30 further includes a resistance arm 37 arranged on one side of the substrate 31 away from the dial 10. The resistance arm 37 has an elasticity and is configured to resist against the driving member 13 to provide a resistance. When the dial 10 is rotated in the second direction R, a force applied by the driving member 13 to drive the resistance arm 37 is greater than or equal to the resistance, the pawl disc 30 is rotated in the second direction R. By the above structural arrangement, when the dial 10 is touched and rotated in the second direction R, the resistance arm 37 resists against the driving member 13, so that the rotation of the driving member 13 is affected by the resistance of the resistance arm 37. When a force applied to the dial 10 is less than the resistance of the resistance arm 37 to the driving member 13, the driving member 13 and the dial 10 remain stationary, thereby avoiding the impact on the pawl disc 30, ensuring that the pawl disc 30 and the spool 50 do not rotate, and avoiding occurrence of lace loosening due to accidental touch. In order to avoid product malfunction caused by the dial 10 being separated from the housing 40 in the process of lifting the dial 10 to completely loosen the lace, the dial 10 further includes a first snap 17. The first snap 17 is arranged on an inner side of the side wall 53. The housing 40 is provided with a second snap 45. The second snap 45 is arranged on an outer side of the barrel-shaped main body 41. The first snap 17 is configured to be fastened with the second snap 45 to prevent the dial 10 from being separated from the housing 40. Specifically, the first snap 17 is a snap, and the second snap 45 is arranged on an outer edge of the barrel-shaped main body 41 of the housing 40, so that the first snap 17 can be fastened onto the second snap 45, thus ensuring that the dial 10 is not separated from the housing 40 when lifted.

The connecting piece 23 includes a main body part 231, a connecting block 232 arranged on the main body part 231, and a first tooth 233 arranged at one end of the main body part 231. The pawl disc 30 further includes a connecting slot 35 extending in an axial direction of the substrate 31. The connecting slot 35 is communicated to the first through hole 31. The connecting block 232 is arranged in the connecting slot 35 and can slide along the connecting slot 35, so that the connecting piece 23 can move in an axial direction of the first through hole 31. A second tooth 56 is arranged on one side of the first base plate 51 away from the second base plate 52. The second tooth 56 is configured to be meshed with the first tooth 233, so that the connecting piece 23 can push the spool 50 to rotate in the first direction F, and the connecting piece 23 can rotate in the second direction R to be demeshed from the spool 50. Specifically, the first tooth 233 and the second tooth 56 are both annular shuttles formed by connecting a plurality of meshing teeth. When the connecting piece 23 is rotated in the second direction R and demeshed from the spool 50, the connecting piece 23 moves along the connecting slot 35, namely, moves in the axial direction of the first through hole 31*a*. It can be understood that the connecting block 232 is located in the connecting slot 35, so that the connecting piece 23 can only move in the axial direction of the first through hole 31*a*, and cannot move in a circumferential direction of the first through hole 31*a*. Therefore, when the pawl disc 30 is rotated, under the action of the connecting slot 35 and the connecting block 232, the connecting piece 23 can rotate with the pawl disc 30.

Figure 11:
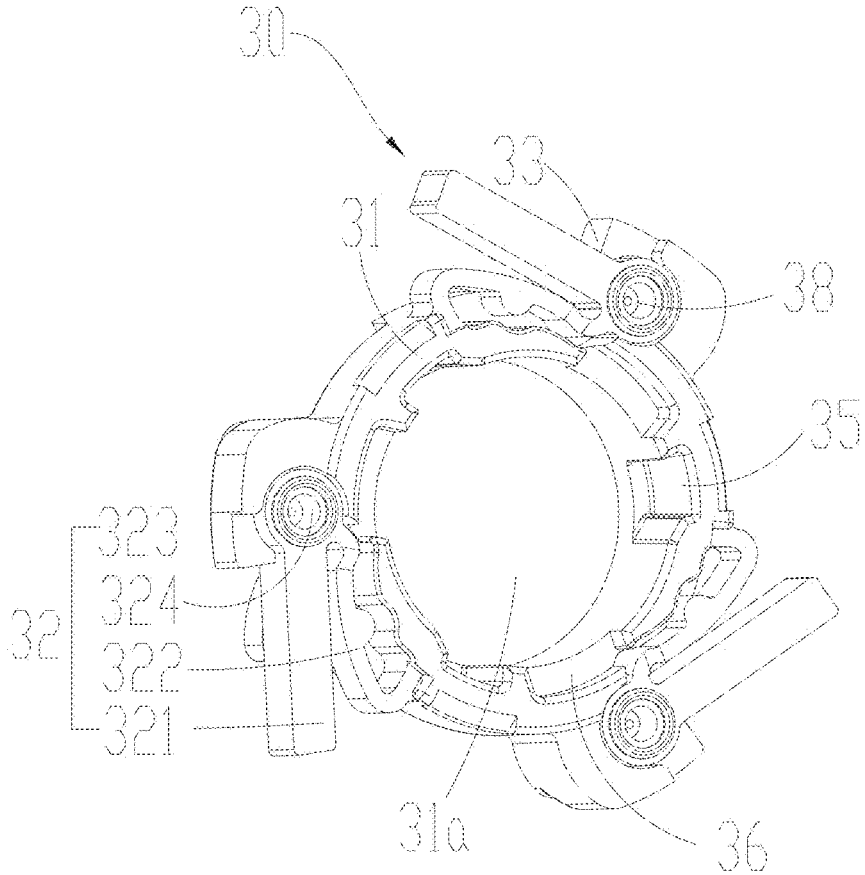
FIG. 11 is a schematic diagram of a pawl disc of the lace tightening and loosening device shown in FIG. 1.
Figure 12:
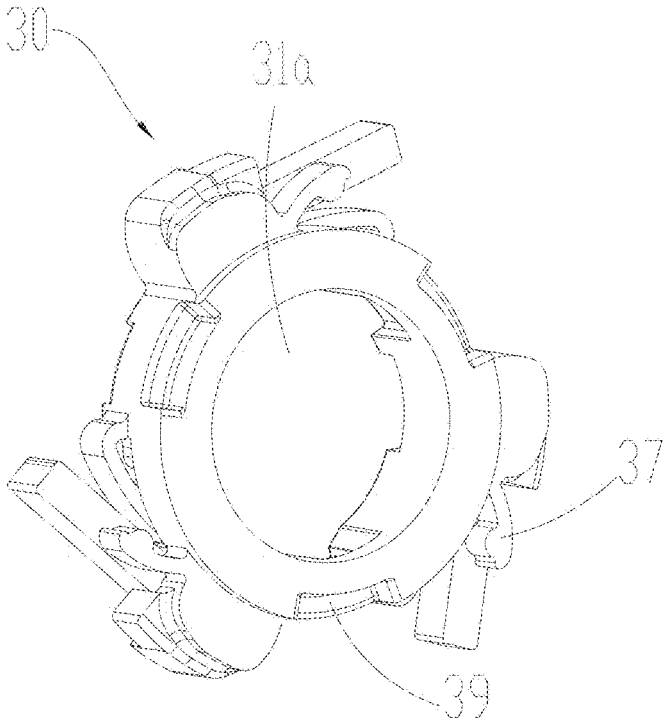
FIG. 12 is a schematic diagram of the pawl disc shown in FIG. 11, viewed in another angle.
Figure 14:
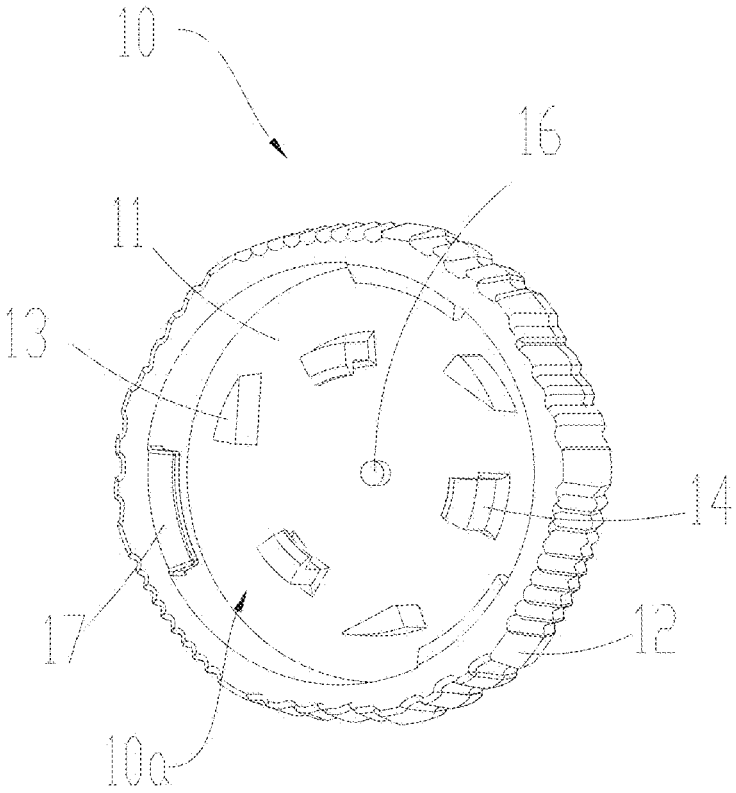
FIG. 14 is a schematic diagram of an initial state of the pawl disc shown in FIG. 13, viewed in another angle.

In order to reduce the production costs and ensure the strength of the pawl disc 30, the pawl disc 30 is integrally formed, and the cylinder 323 and the connecting column 38 are detachably connected through the connecting hole 324. Referring to FIG. 13 and FIG. 14, an initial state of the pawl disc 30 is shown. After the pawl disc 30 is produced and manufactured, the cylinder 323 is not connected to connecting column 38. In this case, the connecting hole 324 is separated from the connecting column 38, and the elastic arm 322 has an elasticity and can have a deformation. When the pawl disc 30 needs to be mounted on the lace tightening and loosening device 1, before assembling, the cylinder 323 is mounted onto the connecting column 38, namely, the connecting hole 324 sleeves the connecting column 38, as shown in FIG. 11 and FIG. 12. In this design, a quantity of parts of the pawl disc 30 is effectively reduced, the production costs are reduced, and the assembling efficiency is improved.

In order to ensure the meshing strength of the first tooth 233 and the second tooth 56 and facilitate their separation, the first tooth 233 includes a first inclined surface 233*a* and a first arc-shaped surface 233*b* facing away from the first inclined surface 233*a*. The second tooth 56 includes a second inclined surface 561 and a second arc-shaped surface 562 facing away from the second inclined surface 561. The first inclined surface 233*a* is configured to resist against the second inclined surface 561, which enables the connecting piece 23 to push the spool 50 to rotate in the first direction F. The first arc-shaped surface 233*b* is configured to resist against the second arc-shaped surface 562, which enables the connecting piece 23 to rotate in the second direction R and be demeshed from the spool 50.

Figure 25:
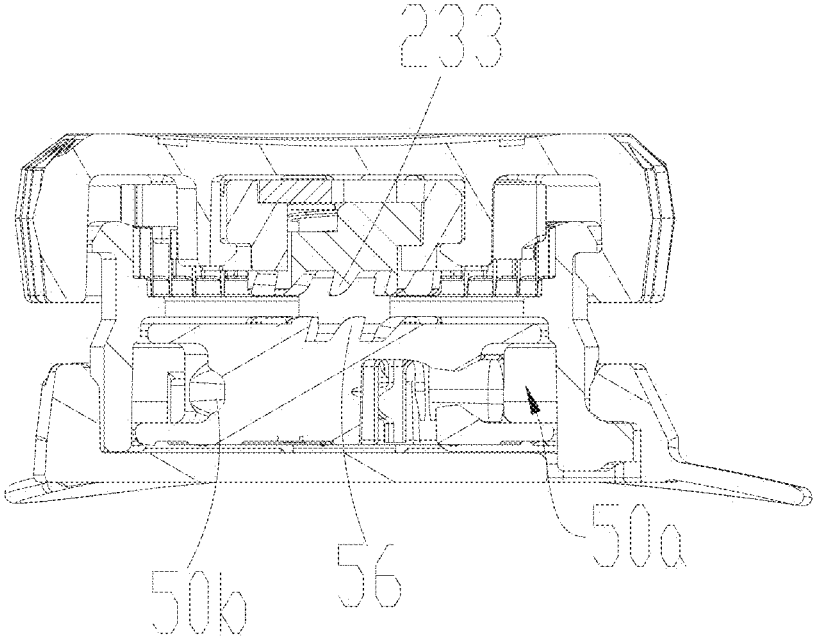
FIG. 25 is a sectional view of a state of tightening a lace of a lace tightening and loosening device according to an embodiment of the present invention.
Figure 26:
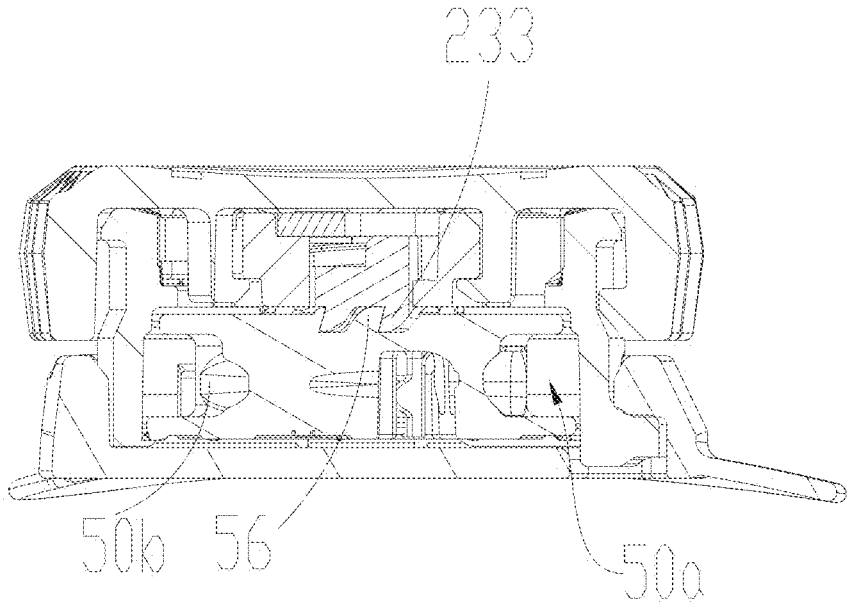
FIG. 26 is a sectional view of a lace of a lace tightening and loosening device for finely adjusting and loosening a lace according to an embodiment of the present invention.

Referring to FIG. 25, when the connecting piece 23 is rotated in the first direction F, the first inclined surface 233*a* resists against the second inclined surface 561. Since the first inclined surfaces and the second inclined surfaces are both inclined surfaces, they can achieve a tight contact, thereby avoiding separation of the first tooth 233 from the second tooth 56 under a force. This enables the connecting piece 23 to push the spool 50 to rotate in the first direction F, to tighten the lace. Referring to FIG. 26, when the connecting piece 23 is rotated in the second direction R, the first arc-shaped surface 233*b* and the second arc-shaped surface 562 resist against each other. Since the first arc-shaped surface and the second arc-shaped surface are both arc-shaped surfaces, resistance during their separation can be lower, and a movement distance of the connecting piece 23 in the axial direction of the first through hole 31*a* becomes shorter, facilitating their separation. This enables the spool 50 to loosen a portion of the lace under the tension of the lace. In other embodiments, the second arc-shaped surface 562 and the first arc-shaped surface 233*b* may also be inclined surfaces.

In this embodiment, the connecting plate 211 is provided with a first connecting part 213. The substrate 31 of the pawl disc 30 is provided with a second connecting part 36. The first connecting part 213 is connected to the second connecting part 36. Specifically, one of the first connecting part 213 and the second connecting part 36 is a convex block, and the other one is a groove. The convex block is clamped with the groove to achieve their connection. In detail, the first connecting part 213 is a convex block, and the second connecting part 36 is a groove. There are three first connecting parts 213 and three second connecting parts 36. The three first connecting parts 213 are arranged around an outer side of the connecting plate 211 and are uniformly distributed, thereby facilitating manufacturing and assembling, and improving the production efficiency. Due to the connection between the first connecting parts 213 and the second connecting parts 36, when the dial 10 drives the pawl disc 30 to rotate, the pawl disc 30 drives the positioning member 21 to rotate.

The connecting piece 23 is provided with a resisting surface 234 on one side away from the first base plate 51. One end of the elastic member 22 resists against the resisting surface 234, and the other end resists against the connecting plate 211, to reset the connecting piece 23. Continuing to refer to FIG. 26, when the connecting piece 23 is rotated in the second direction R, the first tooth 233 is demeshed from the second tooth 56 of the spool 50. During the demeshing, the connecting piece 23 moves in the axial direction of the first through hole 31*a*, namely, the connecting piece 23 is away from the spool 50, thereby pressing the elastic member 22, causing the elastic member 22 to be compressed and generate a rebound force. When the first tooth 233 and the second tooth 56 are completely separated, the rebound force of the elastic member 22 pushes the connecting piece 23 to move in the axial direction of the first through hole 31*a*, namely, pushing the connecting piece 23 towards the spool 50, causing the first tooth 233 and the second tooth 56 to be meshed again. Thus, when the dial 10 is rotated in the second direction R, the spool 50 loosens the lace under the tension of the lace. The connecting piece 23 is continuously meshed with and demeshed from the second meshing part 321 of the spool 50 under the rebound force of the elastic member 22, so that the lace can only be slowly loosened. Namely, the lace is loosened along the meshing teeth of the second meshing part 321 one by one, which achieves fine adjustment of the loosening of the lace.

In this embodiment, the post 212 includes a first end portion 217 and a second end portion 218 opposite to the first end portion 217. The first end portion 217 is connected to the connecting plate 211. The post 212 is provided with an annular groove 216 in one end close to the second end portion 218. A bulge 57 is arranged on the spool 50. The bulge 57 is arranged in the annular groove 216. The second end portion 218 is located on one side of the bulge 57 away from the first end portion 217. The bulge 57 can slide in a circumferential direction of the annular groove 216. the post 212 moves in the axial direction to separate the annular groove 216 from the bulge 57, and the second end portion 218 resists against one side of the bulge 57 facing the first end portion 217. Specifically, a wall of the annular groove 216 and a surface of the bulge 57 are both arc-shaped, so that a frictional force during the relative rotation and movement between the bulge 57 and the annular groove 216 is reduced, wear of the product is reduced, and the service life of the product is prolonged. When the dial 10 is lifted, the dial 10 drives the pawl disc 30 to lift the positioning member 21 together, thereby driving the elastic member 22 and the connecting piece 23 to be lifted together. Thus, the annular groove 216 of the positioning member 21 is separated from the bulge 57 of the spool 50, and the second end portion 218 of the positioning member 21 to resist against the bulge 57 towards one side of the dial 10, so that the dial 10, a connecting mechanism, and the pawl disc 30 are jointly separated from the spool 50, and the lace inside the spool 50 can be completely loosened.

Referring to FIG. 6 to FIG. 10, a damping member 55 is arranged on a side surface of the second base plate 52 of the spool 50 away from the first base plate 51. A plurality of damping members 55 are provided, which are annularly arranged along an edge of the second base plate 52. The damping member 55 has a third inclined surface 551, a fourth inclined surface 552, and a sliding part 553. One end of the third inclined surface 551 and one end of the fourth inclined surface 552 are respectively connected to the second base plate 52, and the other ends are respectively connected to two opposite sides of the sliding part 553. A height of the sliding part 553 protrudes out of a surface of the second base plate 52, so that the third inclined surface 551 and the fourth inclined surface 552 are inclined relative to the surface of the second base plate 52. The third inclined surface 551 and the fourth inclined surface 552 can be planes or curved surfaces.

When the spool 50 is rotated, at least one damping member 55 resists against the first limiting member 481 and/or the second limiting member 482 on the housing 40, thereby generating a resistance to prevent the spool 50 from rotating. Specifically, one of the third inclined surface 551 or the fourth inclined surface 552 of the damping member 55 resists against a side wall of the first limiting member 481 and/or the second limiting member 482, thereby generating a resistance. When a force that rotates the spool 50 is greater than the resistance, the first limiting member 481 and/or the second limiting member 482 slides along one of the third inclined surface 551 and the fourth inclined surface 552, and slides off from the other one. In this process, the first limiting member 481 and/or the second limiting member 482 resists against the sliding part 553 towards a side surface of the spool 50 and slide relative to the sliding part 553. In this case, the spool 50 is rotated relative to the housing 40, so that the lace is tightened or loosened. In this embodiment, a maximum perimeter of the second base plate 52 between every two damping members 55 is greater than perimeters of portions, resisting against the second base plate 52, of the first limiting member 481 and the second limiting member 482, so that the first limiting member 481 or the second limiting member 482 can be located between the two damping members 55 to achieve resistive sliding or separation from the damping members 55, thereby controlling a length of tightening or loosening of the lace. When the first limiting member 481 and/or the second limiting member 482 resists against the sliding part 553 and slides relative to the sliding part, the spool 50 moves towards the dial 10.

In this way, when the dial 10 is rotated in the first direction F, the connecting piece 23 pushes the spool 50 to rotate in the first direction F to tighten the lace. In this case, a pushing force is greater than the resistance generated by the first limiting member 481 and/or the second limiting member 482 to the damping members 55, and the spool 50 is rotated in the first direction F relative to the housing 40. When the dial 10 is rotated in the second direction R, the connecting piece 23 is rotated in the second direction R and separated from the spool 50. In this case, under the tension of the lace, the spool 50 needs to rotate in the second direction R to loosen the lace. When the tension of the lace is greater than the resistance of the first limiting member 481 and/or the second limiting member 482 to the damping members 55, the spool 50 is rotated in the second direction R relative to the housing 40. In this case, the lace is slowly loosened under an external tension.

The dial 10 is provided with a first positioning part 16. A second positioning part 214 is arranged on one side of the connecting plate 211 away from the post 212. The first positioning part 16 is connected to the second positioning part 214. Specifically, the first positioning part 16 is a positioning protrusion, and the second positioning part 214 is a groove, so that when the positioning member 21 is assembled, the assembling efficiency can be improved, and damage to a product component due to an assembling error can be avoided. A convex strip 215 is further arranged on one side surface of the connecting plate 211 away from the post 212, to resist against the cover plate 11 of the dial 10, so as to reduce a frictional force between the cover plate 11 and the connecting plate 211 and reduce wear.

Figure 7:
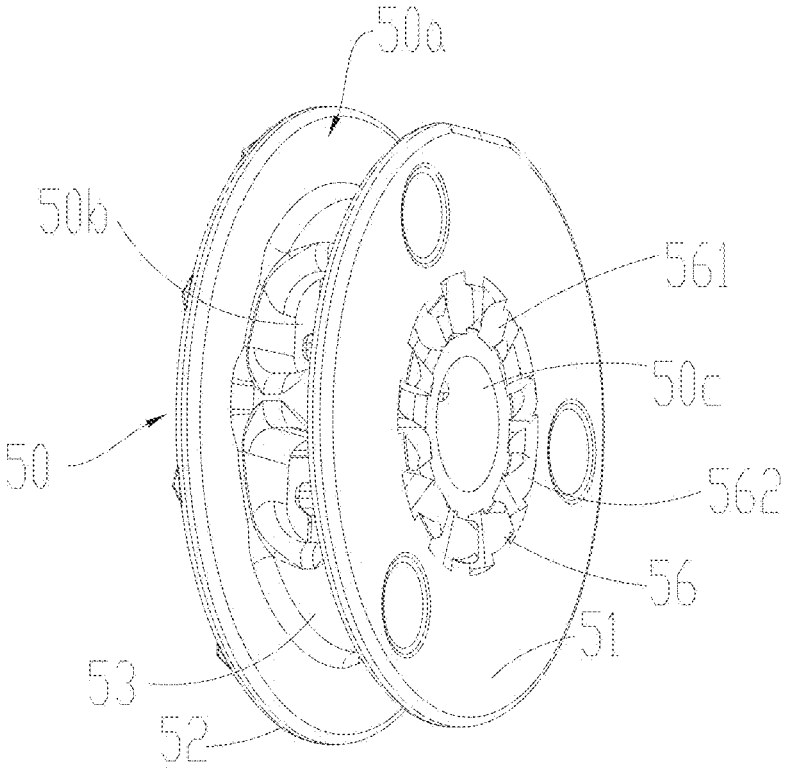
FIG. 7 is a schematic diagram of a spool of the lace tightening and loosening device shown in FIG. 1.
Figure 8:
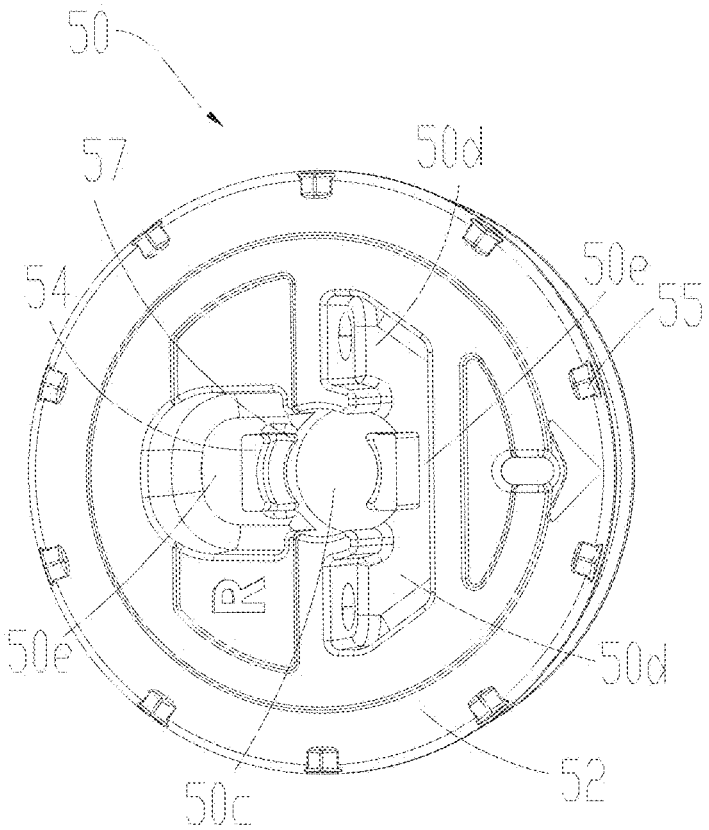
FIG. 8 is a schematic diagram of the spool shown in FIG. 7, viewed in another angle.
Figure 9:
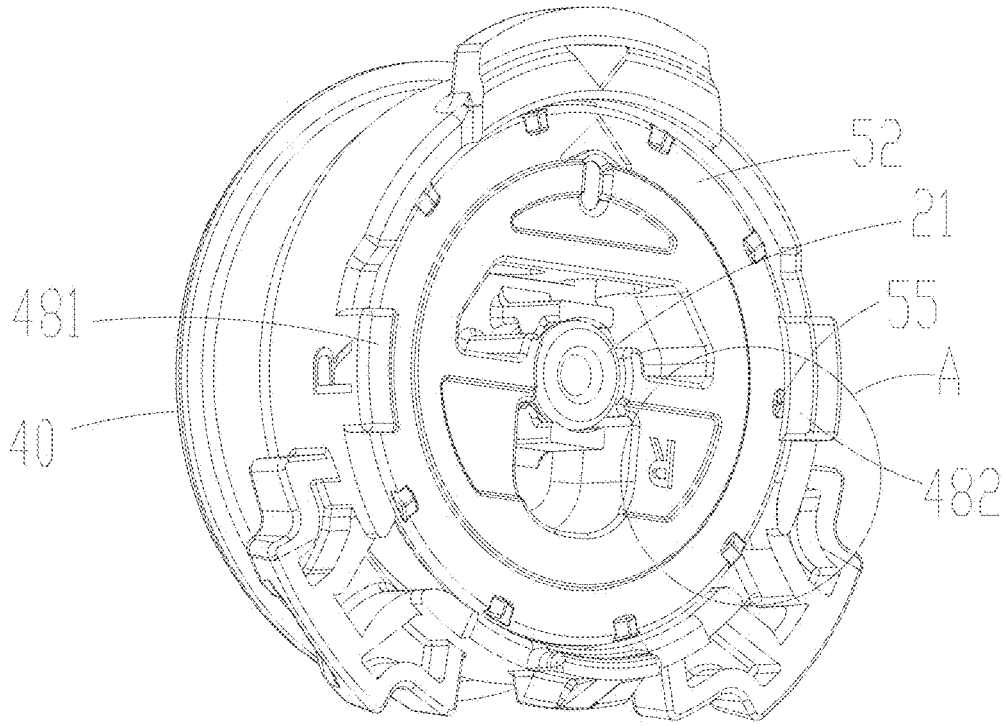
FIG. 9 is a partially schematic structural diagram of a housing and a spool of the lace tightening and loosening device shown in FIG. 1.
Figure 10:
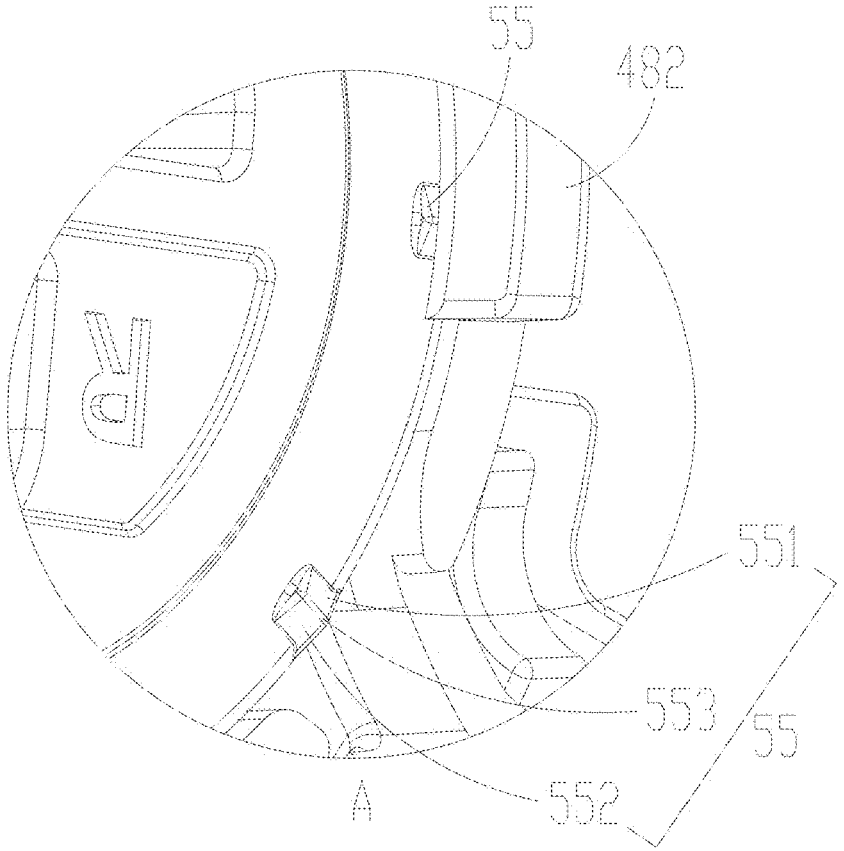
FIG. 10 is an enlarged view of part A in FIG. 9.

Referring to FIG. 7 and FIG. 8, the spool 50 includes a third through hole 50*c* that penetrates through the first base plate 51 and the second base plate 52, and the post 212 is arranged in the third through hole 50*c* in a penetrating manner. The spool 50 includes a wall plate 54. The wall plate 54 is connected to the first base plate 51 and extends towards the second base plate 52. A wall of the third through hole 50*c* includes the wall plate 54, and the bulge 57 is arranged on one side of the wall plate 54 facing the third through hole 50*c*. In this embodiment, two wall plates 54 are provided, which are opposite to each other. Two bulges 57 are provided. Since the post 212 moves in the axial direction of the third through hole 50*c*, the bulge 57 is separated from the annular groove 216 and resists against the second end portion 218 of the post 212, so that the wall plates 54 deform. Namely, the two wall plates 54 can deform in opposite directions, so that the bulges 57 can be separated from the annular groove 216. Therefore, in this embodiment of the present invention, an avoidance space 50*e* is provided in one side of each wall plate 54 away from each bulge 57 to facilitate the deformation of each wall plate 54.

In this embodiment, in order to allow the lace to be observed during knotting, the spool 50 further includes an open slot 50*d*. The open slot 50*d* is covered at the second base plate 52 and extends towards the first base plate 51. The open slot 50*d* is communicated to the second threading hole 50*b*. In this way, the lace passes through the second threading hole 50*b*. During knotting in the open slot 50*d*, a knotting situation and a knot that can accommodate the lace can be directly observed, so that the overall appearance of the product is more beautiful and tidier.

Figure 3:
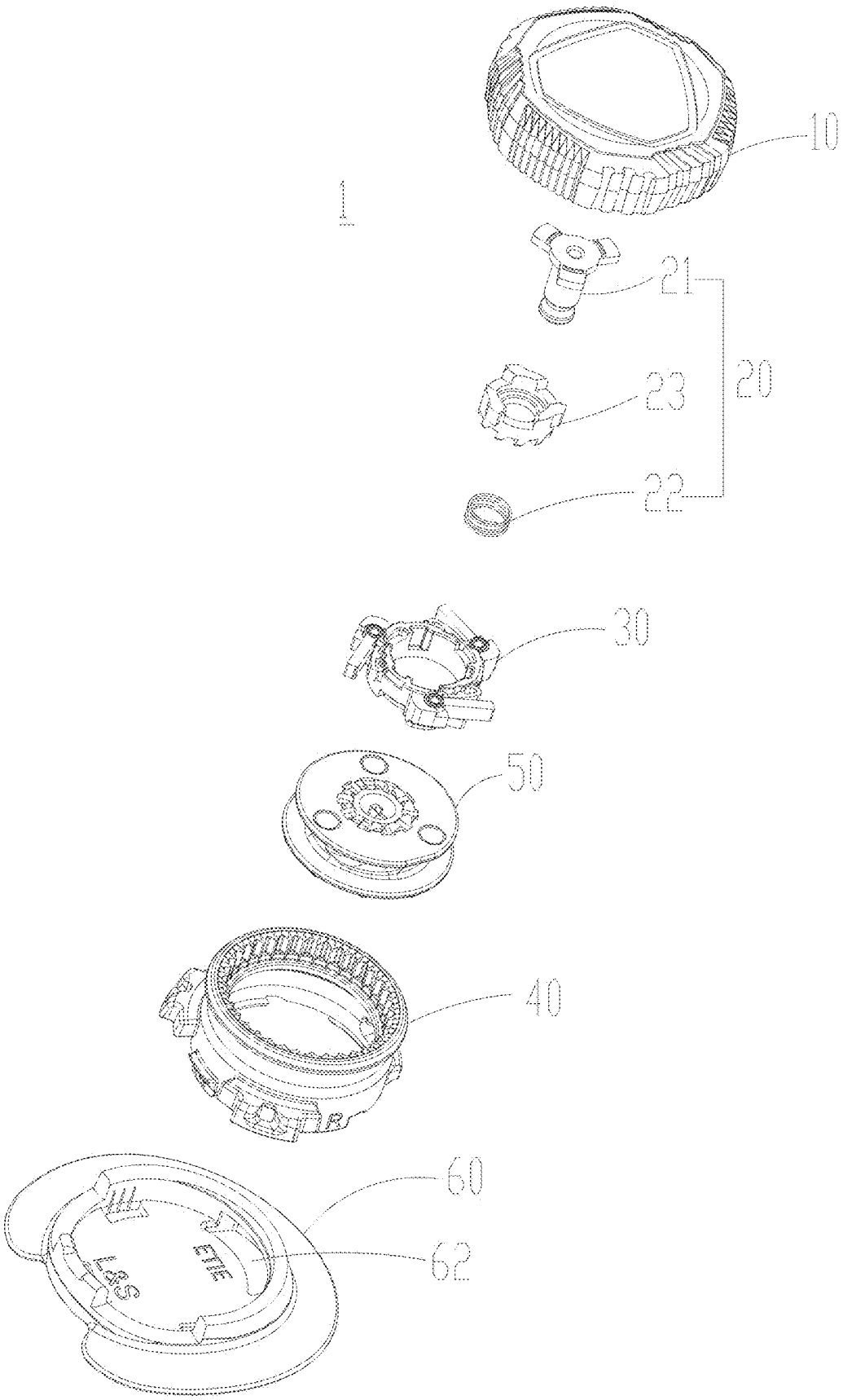
FIG. 3 is an exploded view of the lace tightening and loosening device shown in FIG. 1.
Figure 4:
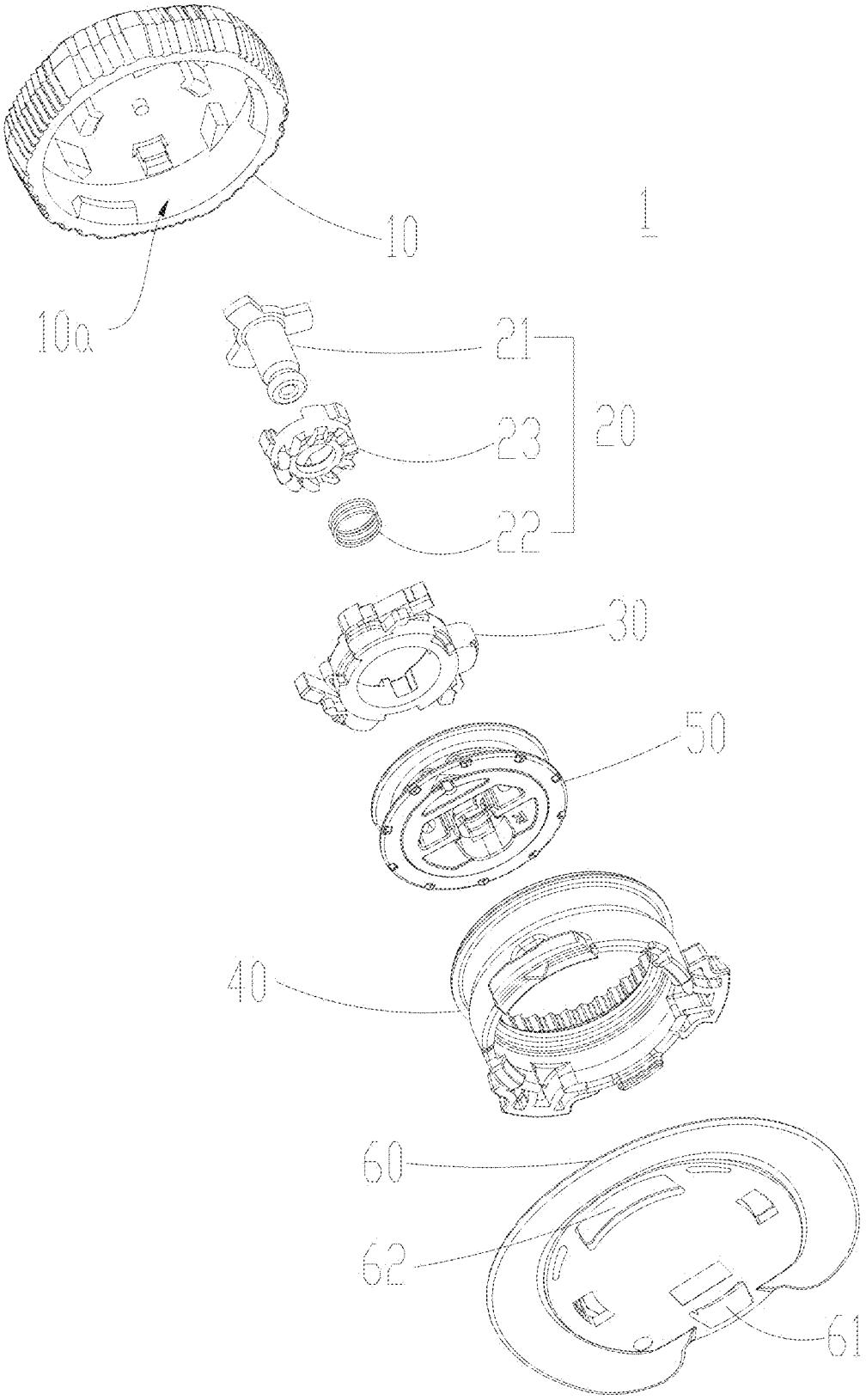
FIG. 4 is an exploded view of the lace tightening and loosening device shown in FIG. 1, viewed in another angle.
Figure 6:
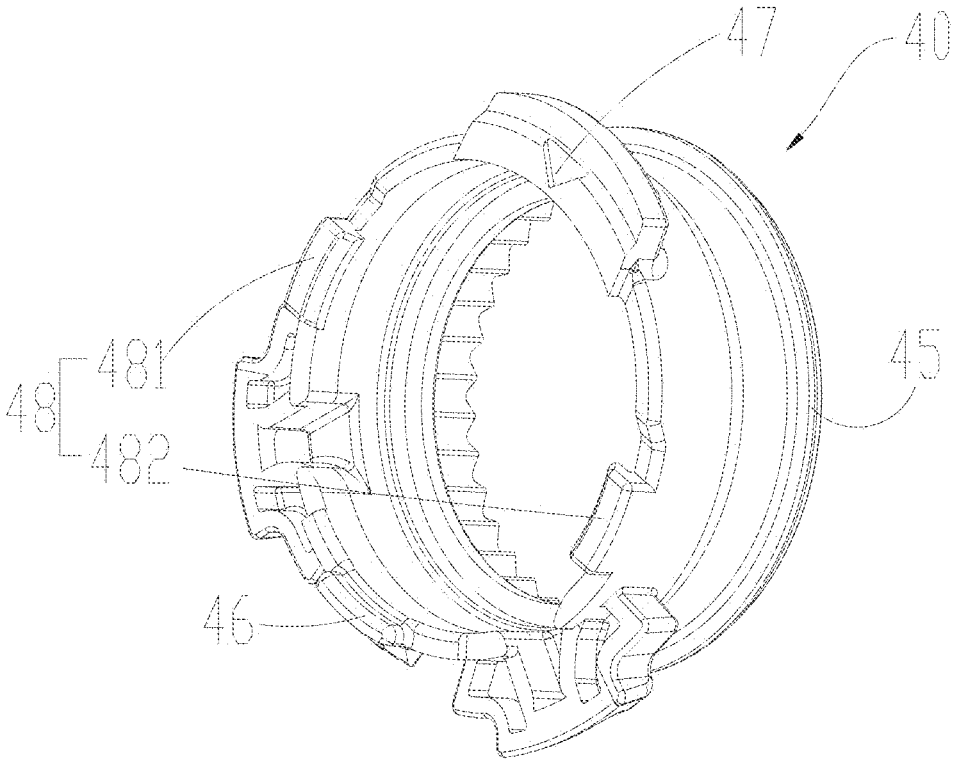
FIG. 6 is a schematic diagram of the housing shown in FIG. 5, viewed in another angle.

Continuing to refer to FIG. 3, FIG. 4, and FIG. 6, the housing 40 further includes a third snap 46 and a fourth snap 47. The chassis 60 is provided with a fifth snap 61 and a sixth snap 62. The third snap 46 and the fourth snap 47 are respectively fastened with the fifth snap 61 and the sixth snap 62, thereby detachably connecting the housing 40 to the chassis 60, and further connecting the lace tightening and loosening device 1 to an object through the chassis 60.

Compared with the prior art, the pawl disc 30 provided in the present invention is integrally formed, and the cylinder 323 and the connecting column 38 can be detachably connected. After production and manufacturing, during mounting and use, only the cylinder 323 needs to be mounted on the connecting column 38, which effectively reduces a quantity of parts that achieve a function of the pawl disc 30, and ensuring the strength of the pawl disc 30, so that it is convenient for production and manufacturing of the pawl disc 30, thereby reducing the production costs. The lace tightening and loosening device 1 provided in the present invention can rotate the dial 10 in the first direction F to drive the spool 50 to tighten the lace. When the dial 10 is rotated in the second direction R to separate the pawl disc 30 and the connecting structure 20 from the spool 50. The lace can be loosened when an external force is applied to the spool 50. When no external force is applied to the lace, the spool 50 remains stationary, and when the dial 10 is further rotated in the second direction R, the dial 10, the pawl disc 30, and the connecting structure 20 remain idling, so that the spool 50 cannot be pushed to rotate in the second direction R, thereby ensuring that the lace is not squeezed out, avoiding a situation such as loosening or knotting of the lace inside the spool 50, and then ensuring the service life of the product. Since the second clamping part 14 with the first clamping part 39 are clamped, the dial 10 is connected to the pawl disc 30. Therefore, when the dial 10 is lifted, the pawl disc 30 and the connecting structure 20 are also lifted, so that the connecting structure 20 is separated from the spool 50. This makes the lace drive the spool 50 to rotate in the second direction R under the external force, to completely loosen the lace.

In a second aspect, the present invention further provides wearable clothing. The wearable clothing includes a first part, a second part, and a lace. A gap is reserved between the first part and the second part. The wearable clothing further includes the foregoing lace tightening and loosening device 1. The lace tightening and loosening device 1 is configured to tighten or loosen the lace to tighten or loosen the first part and the second part, thereby fixing the wearable clothing onto a human body part. The wearable clothing may be a shoe 2, a hat 3, a glove 4, a medical protective gear 5, a helmet, a skiing protective gear, clothes, and another object.

Figure 27:
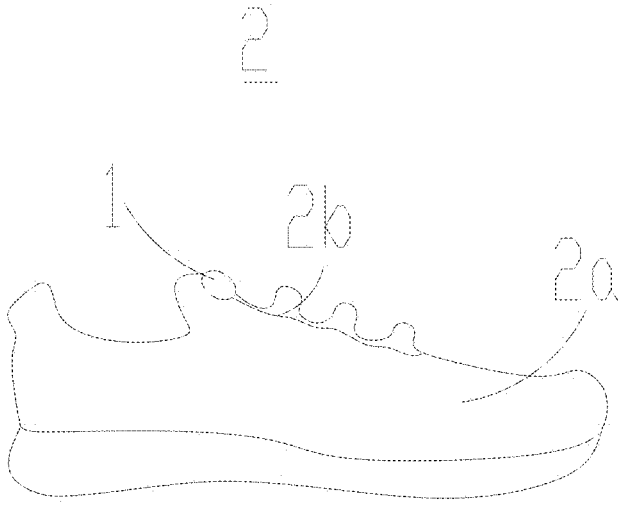
FIG. 27 is a schematic structural diagram of a shoe according to an embodiment of the present invention.

Referring to FIG. 27, an embodiment of the present invention further provides a shoe 2. The shoe 2 includes a shoe body 2*a*, a shoelace 2*b*, and the lace tightening and loosening device 1 of any of the above embodiments. The shoelace 2*b* is the lace, and the lace tightening and loosening device 1 is configured to tighten or loosen the shoelace 2*b*. The lace tightening and loosening device 1 can be fixed on the shoe body 2*a*. In this embodiment, one side of the shoe body 2*a* is the first part, and the other side is the second part. The lace is the shoelace 2*b*. The shoelace 2*b* passes through the two parts to tighten or release the two parts of the shoe body 2*a*, making it easier for a user to put on the shoe.

In this embodiment, using the lace tightening and loosening device 1 of any of the above embodiments is used to tighten or loosen the shoelace 2*b* is simple. A quantity of integrated elements of the lace tightening and loosening device 1 is small, thus reducing the assembling costs, improving the assembling efficiency, making the entire structure compact, and facilitating the miniaturization and weight reduction of the lace tightening and loosening device 1. Moreover, the small quantity of the elements can also improve the stability of the entire structure, so that the reliability of the lace tightening and loosening device 1 is improved, and the service life of the lace tightening and loosening device 1 is prolonged.

Figure 28:
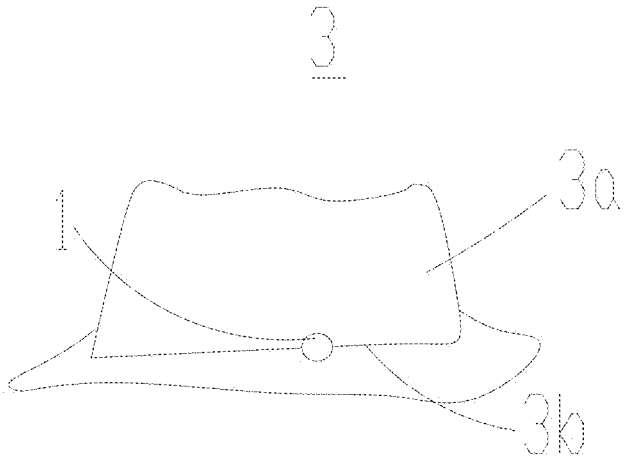
FIG. 28 is a schematic structural diagram of a hat according to an embodiment of the present invention.

Referring to FIG. 28, an embodiment of the present invention further provides a hat 3. The hat 3 includes a hat body 3*a*, a hat lace 3*b*, and the lace tightening and loosening device 1 of any of the above embodiments. The hat lace 3*b* is configured to tighten or loosen the hat body 3*a*. The hat lace 3*b* is the lace, and the lace tightening and loosening device 1 is configured to tighten or loosen the hat lace 3*b*. The lace tightening and loosening device 1 can be fixed on the hat body 3*a*. In this embodiment, two sides of the hat body 3*a* are respectively the first part and the second part. The lace is the hat lace 3*b*, which connects the two parts to tighten or loosen the hat body 3*a*.

In this embodiment, using the lace tightening and loosening device 1 of any of the above embodiments is used to tighten or loosen the hat lace 3*b* is simple. A quantity of integrated elements of the lace tightening and loosening device 1 is small, thus reducing the assembling costs, improving the assembling efficiency, making the entire structure compact, and facilitating the miniaturization and weight reduction of the lace tightening and loosening device 1. Moreover, the small quantity of the elements can also improve the stability of the entire structure, so that the reliability of the lace tightening and loosening device 1 is improved, and the service life of the lace tightening and loosening device 1 is prolonged.

Figure 29:
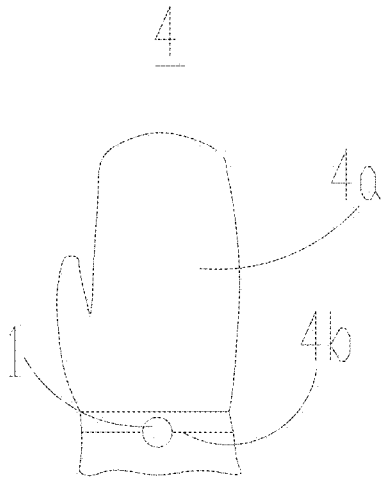
FIG. 29 is a schematic structural diagram of a glove according to an embodiment of the present invention.

Referring to FIG. 29, an embodiment of the present invention further provides a glove 4. The glove 4 includes a glove body 4*a*, a glove lace 4*b*, and the lace tightening and loosening device 1 of any of the above embodiments. The glove lace 4*b* is configured to tighten or loosen the glove body 4*a*. The glove lace 4*b* is the lace, and the lace tightening and loosening device 1 is configured to tighten or loosen the glove lace 4*b*. The lace tightening and loosening device 1 can be fixed on the glove body 4*a*. In this embodiment, the glove body 4*a* has a first part and a second part. The first part and the second part are located at an opening. The lace is the glove lace 4*b*, which twists the two parts to tighten or loosen the glove body 4*a*.

In this embodiment, using the lace tightening and loosening device 1 of any of the above embodiments is used to tighten or loosen the glove lace 4*b* is simple. A quantity of integrated elements of the lace tightening and loosening device 1 is small, thus reducing the costs, improving the assembling efficiency, making the entire structure compact, and facilitating the miniaturization and weight reduction of the lace tightening and loosening device 1. Moreover, the small quantity of the elements can also improve the stability of the entire structure, so that the reliability of the lace tightening and loosening device 1 is improved, and the service life of the lace tightening and loosening device 1 is prolonged.

Figure 30:
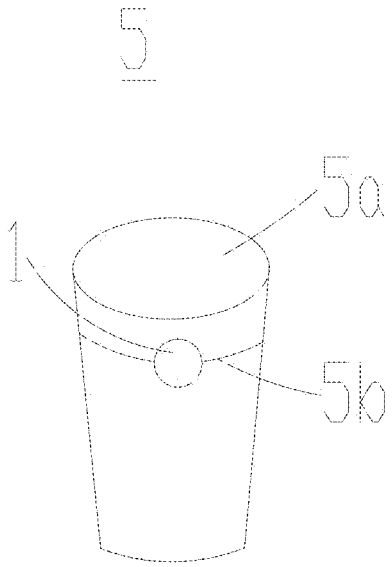
FIG. 30 is a schematic structural diagram of a medical protective gear according to an embodiment of the present invention.

Referring to FIG. 30, an embodiment of the present invention further provides a medical protective gear 5. The medical protective gear 5 includes a medical protective gear body 5*a*, a medical protective gear lace 5*b*, and the lace tightening and loosening device 1 of any of the above embodiments. The medical protective gear lace 5*b* is configured to tighten or loosen the medical protective gear body 5*a*. The medical protective gear lace 5*b* is the lace, and the lace tightening and loosening device 1 is configured to tighten or loosen the medical protective gear lace 5*b*. It can be understood that the medical protective gear 5 can be an arm protective gear (such as a sleeve), a leg protective gear (such as a knee pad and a wrist band), or can be a waist or neck protective gear, which is not limited to the above embodiments. In this embodiment, the medical protective gear body 5*a* is divided into a first part and a second part by an opening of the medical protective gear body 5*a*. The lace is the medical protective gear lace 5*b*, which is wrapped around the opening to tighten or loosen the two parts.

In a third aspect, referring to FIG. 31, an embodiment of the present application further provides a storage device 6. The storage device 6 can be, but is not limited to, a backpack, a bag, a storage box, and the like, which includes a storage body 6*a*, a storage belt 6*b*, and the lace tightening and loosening device 1 of any of the above embodiments. The storage belt 6*b* is configured to tighten or loosen the storage body 6*a*. The storage belt 6*b* is the lace, and the lace tightening and loosening device 1 is configured to tighten or loosen the storage belt 6*b*. The lace tightening and loosening device 1 can be fixed on the storage body 6*a*. In this embodiment, the storage body 6*a* has a first part and a second part. A gap is reserved between the first part and the second part, or the first part and the second part can be separated. The lace is the storage belt 6*b*, which passes through the first part and the second part to tighten or loosen the first part and the second part, thereby storing an object into the storage device 6 or taking out an object from the storage device 6.

In this embodiment, using the lace tightening and loosening device 1 of any of the above embodiments is used to tighten or loosen the storage belt 6*b* is simple. A quantity of integrated elements of the lace tightening and loosening device 1 is small, thus reducing the assembling costs, improving the assembling efficiency, making the entire structure compact, and facilitating the miniaturization and weight reduction of the lace tightening and loosening device 1. Moreover, the small quantity of the elements can also improve the stability of the entire structure, so that the reliability of the lace tightening and loosening device 1 is improved, and the service life of the lace tightening and loosening device 1 is prolonged.

The above various embodiments are only used to describe the technical solutions of the present invention, and not intended to limit the present invention. Although the present invention has been described in detail with reference to the foregoing embodiments, those ordinarily skilled in the art should understand that they can still modify the technical solutions described in all the foregoing embodiments, or equivalently replace some or all of the technical features, and these modifications or replacements do not depart the essences of the corresponding technical solutions from the spirit and scope of the technical solutions of all the embodiments of the present invention.

What is claimed is:

1. A lace tightening and loosening device, comprising:

a base, comprising a barrel-shaped main body, a first meshing part arranged on an inner side of the barrel-shaped main body, a partition plate arranged on the inner side of the barrel-shaped main body, and a first threading hole penetrating through the barrel-shaped main body;

a spool, arranged inside the barrel-shaped main body and comprising a first base plate, a second base plate, and a side wall connecting the first base plate to the second base plate, wherein the first base plate is opposite to the second base plate; the first base plate resists against the partition plate, and the second base plate is located on one side of the first base plate away from the partition plate; the first base plate, the second base plate, and the side wall form a winding region for storing a lace; the side wall is provided with a second threading hole that penetrates through the side wall;

a pawl disc, arranged on one side of the first base plate away from the second base plate and comprising a substrate with a first through hole, a pawl connected to the substrate, and a first clamping part arranged on the substrate, wherein the pawl is configured to be meshed with the first meshing part;

a dial, arranged on one side of the pawl disc away from the spool and comprising a cover plate, a side plate connected to one side of the cover plate, a driving member arranged on one side of the cover plate facing the side plate, and a second clamping part arranged on one side of the cover plate facing the side plate, wherein the cover plate and the side plate are enclosed to form an accommodating cavity with an opening; a portion of the barrel-shaped main body is located in the accommodating cavity; the second clamping part is clamped with the first clamping part; and a connecting structure, arranged in the first through hole in a penetrating manner and connecting the pawl disc to the spool, wherein the connecting structure is movably connected to the spool, wherein when the dial is rotated in a first direction, the driving member drives the pawl disc to rotate in the first direction and drive the connecting structure to rotate, thereby driving the spool to rotate in the first direction to tighten a lace; when the dial is rotated in a second direction opposite to the first direction, the driving member drives the pawl to be separated from the first meshing part, so that the pawl disc rotates in the second direction and drives the connection structure to rotate;

meanwhile, under an external force, the lace drives the spool to rotate in the second direction and be loosened from the spool; when no external force is applied, the spool stops rotating; when the dial is lifted axially away from the base under an external force, the pawl disc and the connecting structure are away from the spool, so that the lace is completely loosened from the spool under the external force;

wherein the connecting structure comprises a connecting piece arranged in the first through hole; the connecting piece comprises a main body part, a connecting block arranged at the main body part, and a first tooth arranged at one end of the main body part; the pawl disc further comprises a connecting slot extending in an axial direction of the substrate; the connecting slot is communicated to the first through hole; the connecting block is arranged in the connecting slot and slides along the connecting slot; a second tooth is arranged on one side of the first base plate away from the second base plate; and the second tooth is configured to be meshed with the first tooth, so that the connecting piece pushes the spool to rotate in the first direction, and the connecting piece rotates in the second direction to be demeshed from the spool.

2. The lace tightening and loosening device according to claim 1, wherein the first tooth comprises a first inclined surface and a first arc-shaped surface facing away from the first inclined surface; the second tooth comprises a second inclined surface and a second arc-shaped surface facing away from the second inclined surface; the first inclined surface is configured to resist against the second inclined surface, which enables the connecting piece to push the spool to rotate in the first direction; and the first arc-shaped surface is configured to resist against the second arc-shaped surface, which enables the connecting piece to rotate in the second direction and be demeshed from the spool.

3. The lace tightening and loosening device according to claim 1, wherein the connecting structure further comprises a positioning member and an elastic member; the positioning member comprises a connecting plate and a post connected to the connecting plate; the connecting plate is provided with a first connecting part; the post is arranged in the first through hole in a penetrating manner; the substrate of the pawl disc is provided with a second connecting part; the first connecting part is connected to the second connecting part; the elastic member sleeves the post; the connecting piece is provided with a second through hole; the post is arranged in the second through hole in a penetrating manner; the connecting piece is provided with a resisting surface on one side away from the first base plate; and one end of the elastic member resists against the resisting surface, and the other end resists against the connecting plate to reset the connecting piece.

4. The lace tightening and loosening device according to claim 3, wherein the post comprises a first end portion and a second end portion opposite to the first end portion; the first end portion is connected to the connecting plate; the post is provided with an annular groove in one end close to the second end portion; a bulge is arranged on the spool; the bulge is arranged in the groove; the second end portion is located on one side of the bulge away from the first end portion; the bulge slides in a circumferential direction of the groove; the post moves in the axial direction to separate the groove from the bulge, and the second end portion resists against one side of the bulge facing the first end portion; the dial is provided with a first positioning part; the connecting plate is provided with a second positioning part on one side away from the post; and the first positioning part is connected to the second positioning part.

5. The lace tightening and loosening device according to claim 4, wherein the spool comprises a third through hole penetrating through the first base plate and the second base plate; the post is arranged in the third through hole in a penetrating manner; the spool comprises a wall plate; the wall plate is connected to the first base plate and extends towards the second base plate; a hole wall of the third through hole comprises the wall plate; the bulge is arranged on one side of the wall plate facing the third through hole; the spool further comprises an open slot; the open slot covers the second base plate and extends towards the first base plate; and the open slot is communicated to the second threading hole.

6. The lace tightening and loosening device according to claim 1, wherein the base further comprises a limiting structure; the limiting structure is arranged on one side of the base away from the dial and resists against the second base plate to limit the spool inside the barrel-shaped main body; the second base plate is provided with a plurality of damping members on one side away from the first base plate; the plurality of damping members are arranged around an edge of the second base plate; the damping members are configured to generate resistance when resisting against the limiting structure; and a force that rotates the spool is greater than the resistance, the spool is rotated relative to the base.

7. The lace tightening and loosening device according to claim 1, wherein the pawl disc further comprises a resistance arm arranged on one side of the substrate away from the dial; the resistance arm has an elasticity to resist against the driving member to provide a resistance; when the dial is rotated in the second direction, and a force applied by the driving member to drive the resistance arm is greater than or equal to the resistance, the pawl disc is rotated in the second direction.

8. A lace tightening and loosening device, comprising:

a base, comprising a barrel-shaped main body, a first meshing part arranged on an inner side of the barrel-shaped main body, a partition plate arranged on the inner side of the barrel-shaped main body, and a first threading hole penetrating through the barrel-shaped main body;

a spool, arranged inside the barrel-shaped main body and comprising a first base plate, a second base plate, and a side wall connecting the first base plate to the second base plate, wherein the first base plate is opposite to the second base plate; the first base plate resists against the partition plate, and the second base plate is located on one side of the first base plate away from the partition plate; the first base plate, the second base plate, and the side wall form a winding region for storing a lace; the side wall is provided with a second threading hole that penetrates through the side wall;

a pawl disc, arranged on one side of the first base plate away from the second base plate and comprising a substrate with a first through hole, a pawl connected to the substrate, and a first clamping part arranged on the substrate, wherein the pawl is configured to be meshed with the first meshing part;

a dial, arranged on one side of the pawl disc away from the spool and comprising a cover plate, a side plate connected to one side of the cover plate, a driving member arranged on one side of the cover plate facing the side plate, and a second clamping part arranged on one side of the cover plate facing the side plate, wherein the cover plate and the side plate are enclosed to form an accommodating cavity with an opening; a portion of the barrel-shaped main body is located in the accommodating cavity; the second clamping part is clamped with the first clamping part; and a connecting structure, arranged in the first through hole in a penetrating manner and connecting the pawl disc to the spool, wherein the connecting structure is movably connected to the spool, wherein when the dial is rotated in a first direction, the driving member drives the pawl disc to rotate in the first direction and drive the connecting structure to rotate, thereby driving the spool to rotate in the first direction to tighten a lace; when the dial is rotated in a second direction opposite to the first direction, the driving member drives the pawl to be separated from the first meshing part, so that the pawl disc rotates in the second direction and drives the connection structure to rotate;

meanwhile, under an external force, the lace drives the spool to rotate in the second direction and be loosened from the spool; when no external force is applied, the spool stops rotating; when the dial is lifted axially away from the base under an external force, the pawl disc and the connecting structure are away from the spool, so that the lace is completely loosened from the spool under the external force;

wherein the pawl comprises an elastic arm connected to the substrate, a second meshing part for being meshed with the first meshing part, and a cylinder connected to the elastic arm and the second meshing part; the cylinder is provided with a connecting hole; a connecting column is arranged on one side of the substrate facing the dial; the connecting hole sleeves the connecting column; the pawl disc further comprises a resisting part; the resisting part is arranged on an outer side of the substrate and is adjacent to the connecting column; when the dial is rotated in the first direction, the driving member resists against the resisting part to drive the pawl disc to rotate in the first direction; when the dial is rotated in the second direction, the driving member resists against the second meshing part and moves in a radial direction of the pawl disc; and the cylinder is rotated around the connecting column until the second meshing part is separated from the first meshing part.

9. A lace tightening and loosening device, comprising:

a base, comprising a barrel-shaped main body, a first meshing part arranged on an inner side of the barrel-shaped main body, a partition plate arranged on the inner side of the barrel-shaped main body, and a first threading hole penetrating through the barrel-shaped main body;

a spool, arranged inside the barrel-shaped main body and comprising a first base plate, a second base plate, and a side wall connecting the first base plate to the second base plate, wherein the first base plate is opposite to the second base plate; the first base plate resists against the partition plate, and the second base plate is located on one side of the first base plate away from the partition plate; the first base plate, the second base plate, and the side wall form a winding region for storing a lace; the side wall is provided with a second threading hole that penetrates through the side wall;

a pawl disc, arranged on one side of the first base plate away from the second base plate and comprising a substrate with a first through hole, a pawl connected to the substrate, and a first clamping part arranged on the substrate, wherein the pawl is configured to be meshed with the first meshing part;

a dial, arranged on one side of the pawl disc away from the spool and comprising a cover plate, a side plate connected to one side of the cover plate, a driving member arranged on one side of the cover plate facing the side plate, and a second clamping part arranged on one side of the cover plate facing the side plate, wherein the cover plate and the side plate are enclosed to form an accommodating cavity with an opening; a portion of the barrel-shaped main body is located in the accommodating cavity; the second clamping part is clamped with the first clamping part; and a connecting structure, arranged in the first through hole in a penetrating manner and connecting the pawl disc to the spool, wherein the connecting structure is movably connected to the spool, wherein when the dial is rotated in a first direction, the driving member drives the pawl disc to rotate in the first direction and drive the connecting structure to rotate, thereby driving the spool to rotate in the first direction to tighten a lace; when the dial is rotated in a second direction opposite to the first direction, the driving member drives the pawl to be separated from the first meshing part, so that the pawl disc rotates in the second direction and drives the connection structure to rotate;

meanwhile, under an external force, the lace drives the spool to rotate in the second direction and be loosened from the spool; when no external force is applied, the spool stops rotating; when the dial is lifted axially away from the base under an external force, the pawl disc and the connecting structure are away from the spool, so that the lace is completely loosened from the spool under the external force;

wherein the dial further comprises a first snap; the first snap is arranged on an inner side of the side wall; the base is provided with a second snap; the second snap is arranged on an outer side of the barrel-shaped main body; and the first snap is configured to be fastened with the second snap to prevent the dial from being separated from the base.

10. The lace tightening and loosening device according to claim 1, further comprising a chassis for placing the lace tightening and loosening device on an external object, wherein the chassis is arranged at one end of the base away from the dial; the base further comprises a third snap and a fourth snap; the base is provided with a fifth snap and a sixth snap; and the third snap and the fourth snap are respectively fastened with the fifth snap and the sixth snap.

11. Wearable clothing, comprising a first part, a second part, and a lace, further comprising the lace tightening and loosening device according to claim 1, wherein the lace tightening and loosening device is configured to tighten or loosen the lace to tighten or loosen the first part and the second part, thereby fixing the wearable clothing onto a human body part; and the wearable clothing comprises one of a shoe, a hat, a glove, a medical protective gear, a helmet, a skiing protective gear, and clothes.

12. A storage device, comprising a first part, a second part, and a lace, further comprising the lace tightening and loosening device according to claim 1, wherein the lace tightening and loosening device is configured to tighten or loosen the lace to tighten or loosen the first part and the second part, thereby storing or removing an object into or from the storage device.

13. A pawl disc, applied to a lace tightening and loosening device, wherein the pawl disc comprises an annular hollow substrate, and a pawl arranged on the substrate; the pawl comprises an elastic arm connected to the substrate, and a second meshing part connected to the elastic arm and configured to be meshed with the lace tightening and loosening device; the second meshing part is located at one end of the elastic arm away from the substrate; and the second meshing part is detachably connected to the substrate;

wherein the pawl further comprises a cylinder arranged between the elastic arm and the second meshing part; a connecting column is arranged on the substrate; a connecting hole is provided in the cylinder; the pawl disc is integrally formed; and the cylinder and the connecting column are detachably connected through the connecting hole.

* * * * *